US008720480B2

(12) United States Patent
Yamasaki et al.

(10) Patent No.: US 8,720,480 B2
(45) Date of Patent: May 13, 2014

(54) FLUSH WATER SUPPLY DEVICE, FLUSH WATER TANK ASSEMBLY WITH FLUSH WATER SUPPLY DEVICE, AND FLUSH TOILET WITH FLUSH WATER TANK ASSEMBLY

(71) Applicant: Toto Ltd., Kitakyushu (JP)

(72) Inventors: Atsuko Yamasaki, Kitakyushu (JP); Yuichi Oda, Yukuhashi (JP); Hisashi Koga, Kitakyushu (JP); Haruki Matsuda, Fukuoka (JP); Yukinori Kubozono, Kitakyushu (JP)

(73) Assignee: Toto, Ltd. (JP)

( * ) Notice: Subject to any disclaimer, the term of this patent is extended or adjusted under 35 U.S.C. 154(b) by 0 days.

(21) Appl. No.: 13/849,732

(22) Filed: Mar. 25, 2013

(65) Prior Publication Data

US 2013/0254982 A1 Oct. 3, 2013

(30) Foreign Application Priority Data

Mar. 29, 2012 (JP) ..... 2012-077384

(51) Int. Cl.
*F16K 31/34* (2006.01)
*F16K 31/26* (2006.01)

(52) U.S. Cl.
USPC ..... 137/414; 137/428

(58) Field of Classification Search
USPC ..... 137/413–415, 426, 428
See application file for complete search history.

(56) References Cited

U.S. PATENT DOCUMENTS 5,421,361 A * 6/1995 Johnson ..... 137/414
6,047,725 A * 4/2000 Gish et al. ..... 137/414
6,142,174 A * 11/2000 Nichols-Roy ..... 137/414

* cited by examiner

*Primary Examiner* — Tuan N Nguyen
(74) *Attorney, Agent, or Firm* — Brooks Kushman P.C.

(57) ABSTRACT

A flush water supply device includes: a water supply valve for switching between a water supplying state and a water stopping state with respect of an inside of the flush water tank; a refill water system on a downstream side of the water supply valve and adapted to allow flush water to be supplied to the flush water tank, and further supplied to a toilet main body as refill water, wherein the refill water system includes a common passage-forming portion which forms a common passage having: an inlet port for allowing inflow of the flush water therethrough; a tank-side outlet port for allowing the flush water to flow out toward the flush water tank therethrough; a main unit-side outlet port for allowing the flush water to flow out toward the toilet main body therethrough; and a vent port; and a vacuum break valve in the common passage-forming portion.

8 Claims, 15 Drawing Sheets

FLUSH WATER SUPPLY DEVICE, FLUSH WATER TANK ASSEMBLY WITH FLUSH WATER SUPPLY DEVICE, AND FLUSH TOILET WITH FLUSH WATER TANK ASSEMBLY

CROSS-REFERENCE TO RELATED APPLICATIONS

This application claims priority to JP application JP 2012-077384 filed on Mar. 29, 2012, the disclosure of which is incorporated in its entirety by reference herein.

TECHNICAL FIELD

The present invention relates to a flush water supply device, a flush water tank assembly equipped with the flush water supply device, and a flush toilet equipped with the flush water tank assembly, and, more particularly, to a flush water supply device for supplying flush water to a flush water tank of a flush toilet, a flush water tank assembly equipped with the flush water supply device, and a flush toilet equipped with the flush water tank assembly.

BACKGROUND ART

Heretofore, as a flush water supply device for supplying flush water to a flush water tank of a flush toilet, there has been known one type which comprises a small tank formed in a tub-like shape having a bottom formed with an opening, and a float provided inside the small tank, and a water supply valve which is an openable/closable value adapted to be moved to supply and stop flush water with respect to the flush water tank interlockingly with an up-down movement of the float, as described, for example, Patent Document 1 (JP 3655318B). The water supply valve of the flush water supply device is constructed as a so-called "diaphragm" type which comprises a diaphragm valve provided on an upper side of a water supply pipe and a vacuum break valve integrally provided in the diaphragm valve. The flush water supply device further comprises a filer member provided in an intermediate passage of the water supply pipe on an upstream side of the water supply valve.

SUMMARY OF THE INVENTION

Technical Problem

In the conventional flush water supply device as described in the Patent Document 1, the vacuum break valve and the diaphragm valve are integrally provided, so that a moving distance of the vacuum break valve during opening/closing thereof is relatively small, and the vacuum break valve in a valve open state is liable to narrow a passage for allowing flush water to pass therethrough. Thus, flush water passing through such a narrowed passage is affected by the influence of pressure loss, which gives rise to a problem of fluctuations in an instantaneous flow rate of flush water to be supplied from the water supply valve into the flush water tank, and an instantaneous flow rate of flush water to be supplied from the water supply valve to a refill passage as a refill water for refilling a toilet main unit therewith.

If the fluctuations in the above instantaneous flow rates occur, an amount of refill water to be supplied to the toilet main unit fluctuates, undesirably causing insufficient amounts of refill water or an increase in useless water, and a water accumulation time required for fully storing flush water within the flush water tank also becomes undesirably unstable.

There is another problem that the filter member provided in the intermediate passage of the water supply pipe causes a large pressure loss in flush water passing therethrough, and therefore becomes one of the factors for fluctuations in the instantaneous flow rates.

The present invention has been made to solve the above conventional problems, and an object thereof is to provide a flush water supply device capable of stabilizing an instantaneous flow rate of flush water to be supplied from a water supply valve into a flush water tank, and an instantaneous flow rate of flush water to be supplied to a toilet main unit as refill water for refilling the toilet main unit therewith.

Solution to Problem

In order to achieve the above object, according to a first aspect of the present invention, there is provided a flush water supply device for supplying flush water to a flush water tank of a flush toilet. The flush water supply device comprises: a water supply pipe having an upstream end connected to an external water supply source and extending upwardly from a bottom wall of the flush water tank; a water supply valve for switching between a water supplying state and a water stopping state with respect of an inside of the flush water tank, in terms of flush water supplied from the water supply pipe; a refill water section provided on a downstream side of the water supply valve and adapted to allow flush water supplied from the water supply valve to be supplied to the flush water tank, and further supplied to a toilet main body of the flush toilet as refill water, wherein the refill water section includes a common passage-forming portion which forms a common passage having: an inlet port for allowing therethrough inflow of flush water passing through the water supply valve; a tank-side outlet port for allowing flush water inflowing through the inlet port to flow out toward the inside of the flush water tank therethrough; a main unit-side outlet port for allowing flush water inflowing through the inlet port to flow out toward the toilet main body therethrough; and a vent port formed just above the inlet port and communicated with outside air; and a vacuum break valve provided in the common passage-forming portion. The vacuum break valve has a valve element for opening and closing the common passage, and a valve element holding member adapted to be guided in an up-down direction by an inward wall partially defining the common passage, while clamping the valve element. The valve element of the vacuum break valve is adapted to be movable between the inlet port and the vent port of the common passage in the up-down direction by a given distance.

In the above flush water supply device of the present invention, as compared, for example, to a device in which a water supply valve and a vacuum break valve are integrated together so that a moving distance of the vacuum break valve during opening/closing thereof is relatively small, the valve element of the vacuum break valve can be moved between the inlet port and the vent port of the common passage in the up-down direction by a relatively large given distance. Thus, in a state in which the valve element of the vacuum break valve is moved upwardly to open the inlet port and close the vent port of the common passage, a flush water passing area in the common passage of the common passage-forming portion of the refill water section can be set to a relatively large value. Therefore, an instantaneous flow rate of flush water to be supplied from the refill water section to the inside of the flush water tank, and an instantaneous flow rate of flush water to be supplied from the refill water section to the toilet main unit as refill water for refilling the toilet main unit therewith, can be stabilized. This makes it possible to stabilize a refill amount of refill water for refilling the toilet main unit therewith, and a water accumulation time required for fully storing flush water in the flush water tank.

Preferably, in the flush water supply device of the present invention, the valve element holding member of the vacuum break valve is adapted to be guided in the up-down direction by the inward wall partially defining the common passage, wherein the inward wall partially defining the common passage or the valve element holding member is formed with a point-contact protrusion for allowing the inward wall partially defining the common passage and the valve element holding member to be maintained in point-contact relation with each other.

In the flush water supply device having this feature, the point-contact protrusion formed on the inward wall partially defining the common passage or the valve element holding member allows the valve element holding member of the vacuum break valve to be moved in the up-down direction while being maintained in point-contact relation with the inward wall partially defining the common passage, so that it becomes possible to normally move the valve element of the vacuum break valve in the up-down direction. Therefore, in the state in which the valve element of the vacuum break valve is normally moved upwardly to open the inlet port and close the vent port of the common passage, a flush water passing area in the common passage of the common passage-forming portion of the refill water section can be set to a relatively large value. This makes it possible to stabilize the instantaneous flow rate of flush water to be supplied from the refill water section to the inside of the flush water tank, and the instantaneous flow rate of flush water to be supplied from the refill water section to the toilet main unit as refill water for refilling the toilet main unit therewith. In addition, it becomes possible to stabilize the refill amount of refill water for refilling the toilet main unit therewith, and the water accumulation time required for fully storing flush water in the flush water tank.

Preferably, in the flush water supply device of the present invention, the inlet port of the common passage is circumferentially divided into a plurality of inlet sub-ports by a wall member, wherein at least one of the plurality of inlet sub-ports adjacent to the main unit-side outlet port of the common passage is permanently closed.

In the case where the inlet port of the common passage is circumferentially divided into a plurality of inlet sub-ports by the wall member, and all of the plurality of inlet sub-ports are opened without permanently closing at least one of the inlet sub-ports adjacent to the main unit-side outlet port of the common passage, it is possible to reliably maintain a vacuum breaking capability when the valve element of the vacuum break valve is moved upwardly to open the plurality of inlet sub-ports of the common passage. However, flush water flowing into the common passage through the inlet sub-ports hinders flush water just before flowing out of the tank-side outlet port of the common passage to generate turbulences in the common passage, causing fluctuation in instantaneous flow rate of flush water flowing out of the main unit-side outlet port 26*h* of the common passage 26*c*. In contrast, in the flush water supply device having the above feature, at least one of the inlet sub-ports adjacent to the main unit-side outlet port of the common passage is permanently closed, so that it becomes possible to smoothly guide flush water flowing into the common passage through the inlet sub-ports 26*f*, to the tank-side outlet port and the main unit-side outlet port. Thus, the instantaneous flow rate of flush water to be supplied from the refill water section to the inside of the flush water tank, and the instantaneous flow rate of flush water to be supplied from the refill water section to the toilet main unit as refill water for refilling the toilet main unit therewith, can be stabilized. This makes it possible to stabilize the refill amount of refill water for refilling the toilet main unit therewith, and the water accumulation time required for fully storing flush water in the flush water tank.

Preferably, in the flush water supply device of the present invention, the water supply pipe has an orifice which is formed in a vicinity of an upstream end of a water flow passage provided thereinside, in such a manner that a cross-sectional flow area of the orifice is less than a cross-sectional flow area of the water flow passage at any position on a downstream side of the orifice.

In the flush water supply device having this feature, the orifice is formed in the vicinity of the upstream end of the water flow passage provided thereinside, in such a manner that the cross-sectional flow area of the orifice is less than that of the water flow passage at any position on a downstream side of the orifice, so that it becomes possible to adjust an instantaneous flow rate of flush water depending on the cross-sectional flow area of the orifice. Thus, the instantaneous flow rate of flush water to be supplied from the refill water section to the inside of the flush water tank, and the instantaneous flow rate of flush water to be supplied from the refill water section to the toilet main unit as refill water for refilling the toilet main unit therewith, can be stabilized. This makes it possible to stabilize the refill amount of refill water for refilling the toilet main unit therewith, and the water accumulation time required for fully storing flush water in the flush water tank.

More preferably, in the above flush water supply device, the water supply pipe comprises: a lower water supply pipe extending upwardly from the bottom wall of the flush water tank and having the orifice in a water flow passage provided thereinside; and an upper water supply pipe connected to an upper side of the lower water supply pipe, wherein the upper water supply pipe is internally provided with a filter member for removing foreign particles contained in flush water flowing from the lower water supply pipe into the upper water supply pipe, and wherein a cross-sectional flow area at any position of a passage passing through the filter member is set to be greater than the cross-sectional flow area of the orifice.

In the flush water supply device having the above feature, the upper water supply pipe located on a downstream side of the orifice of the lower water supply pipe is internally provided with the filter member, wherein the cross-sectional flow area at any position of the passage passing through the filter member is set to be greater than the cross-sectional flow area of the orifice, so that it becomes possible to suppress a situation where, when flush water flows from the lower water supply pipe to the upper water supply pipe and passes through the filter member, the filter member is easily clogged due to foreign particles contained in the flush water, and pressure loss occurs during passing through the filter member. Thus, an instantaneous flow rate of flush water can be adjusted depending on the cross-sectional flow area of the orifice, so as to stabilize the instantaneous flow rate of flush water to be supplied from the refill water section to the inside of the flush water tank, and the instantaneous flow rate of flush water to be supplied from the refill water section to the toilet main unit as refill water for refilling the toilet main unit therewith. This makes it possible to stabilize the refill amount of refill water for refilling the toilet main unit therewith, and the water accumulation time required for fully storing flush water in the flush water tank.

More preferably, in the above flush water supply device, the filter member has a water passing portion for allowing flush water to pass therethrough, thereby removing foreign particles from the flush water, and an attaching portion provided at a lower end of the water passing portion, wherein the attaching portion is press-fitted into the upper water supply pipe, whereby the filter member is fixed to the upper water supply pipe.

In the flush water supply device having the above feature, the attaching portion of the filter member is press-fitted into and fixed to the upper water supply pipe, so that it becomes possible to fix the filter member while keeping the water passing portion of the filter member from being twisted, and to avoid an undesirable situation where, due to the twisting of the water passing portion, the cross-sectional flow area of the filter member becomes less than the cross-sectional flow area of the orifice. Thus, an instantaneous flow rate of flush water can be adjusted depending on the cross-sectional flow area of the orifice, so as to stabilize the instantaneous flow rate of flush water to be supplied from the refill water section to the inside of the flush water tank, and the instantaneous flow rate of flush water to be supplied from the refill water section to the toilet main unit as refill water for refilling the toilet main unit therewith. This makes it possible to stabilize the refill amount of refill water for refilling the toilet main unit therewith, and the water accumulation time required for fully storing flush water in the flush water tank.

According to a second aspect of the present invention, there is provided a flush water tank assembly which comprises the above flush water supply device.

In the flush water tank assembly of the present invention, the flush water supply device is capable of stabilizing an instantaneous flow rate of flush water to be supplied to the inside of the flush water tank, and an instantaneous flow rate of flush water to be supplied to the toilet main unit as refill water for refilling the toilet main unit therewith.

According to a third aspect of the present invention, there is provided a flush toilet comprising the above flush water tank assembly.

In the flush toilet of the present invention, the flush water supply device of the flush water tank assembly is capable of stabilizing an instantaneous flow rate of flush water to be supplied to the inside of the flush water tank, and an instantaneous flow rate of flush water to be supplied to the toilet main unit as refill water for refilling the toilet main unit therewith.

Advantageous Effect of Invention

The flush water supply device of the present invention is capable of stabilizing an instantaneous flow rate of flush water to be supplied to the inside of the flush water tank, and an instantaneous flow rate of flush water to be supplied to the toilet main unit as refill water for refilling the toilet main unit therewith.

DESCRIPTION OF EMBODIMENTS

With reference to the accompanying drawings, a flush water supply device according to one embodiment of the present invention, a flush water tank assembly equipped with the flush water supply device, and a flush toilet equipped with the flush water tank assembly, will now be described.

First of all, based on FIG. 1, a flush toilet using a flush water tank assembly equipped with the flush water supply device according to this embodiment will be described below.

Figure 1:
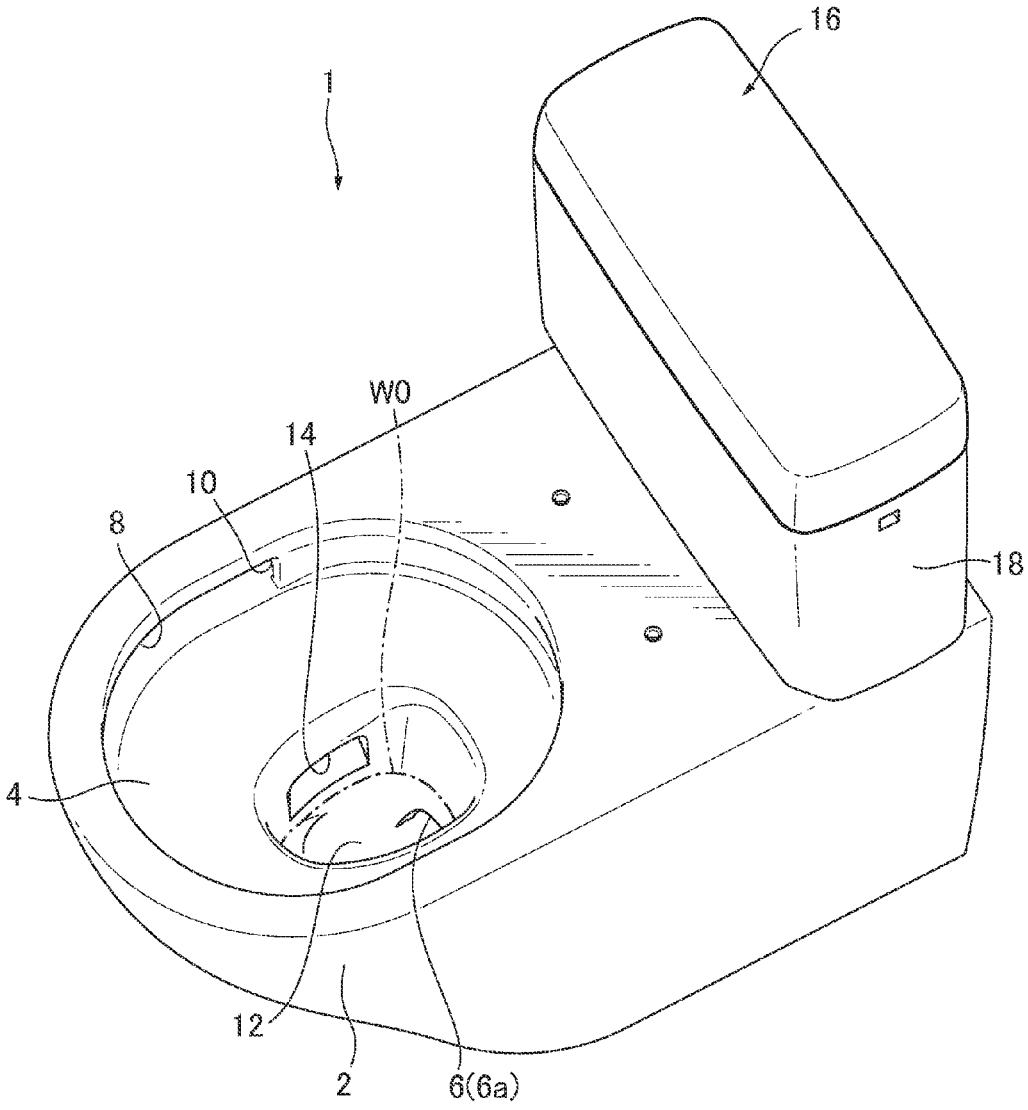
FIG. 1 is a perspective view illustrating a flush toilet using a flush water tank assembly equipped with a flush water supply device according to one embodiment of the present invention, wherein a toilet seat and a toilet cover are removed therefrom.

FIG. 1 is a perspective view illustrating a flush toilet using a flush water tank assembly equipped with the flush water supply device according to this embodiment, wherein a toilet seat and a toilet cover are removed therefrom.

As illustrated in FIG. 1, the reference numeral 1 indicates a so-called siphon-type flush toilet designed to suck waste in a bowl portion and discharge the waste from a drainage trap passage to the outside at once, by means of a siphon action. The flush toilet 1 comprises a toilet main unit 2 made of porcelain. The toilet main unit 2 is formed with a bowl portion 4, and a drainage trap passage 6 communicated with a bottom of the bowl portion 4.

The bowl portion 4 of the toilet main unit 2 has an upper edge formed with an inwardly overhanging rim 8, and a first spout port 10 for spouting flush water supplied from a water conduit (not illustrated) formed inside a rear of the toilet main unit 2. Specifically, the toilet main unit 2 is configured to allow flush water spouted from the first spout port 10 to move downwardly while spirally whirling, along an inner surface thereof, to thereby flush the bowl portion 4.

The bowl portion 4 has a lower region formed as a water pooling region 12 capable of pooling water at up to a water level (pooled-water level) indicated by the one-dot chain line W0. An inlet 6*a* of the drainage trap passage 6 is opened at a bottom of the water pooling region 12, and an outlet of the drainage trap passage 6 located rearward of the inlet 6*a* is connected to a drain pipe (not illustrated) arranged under a floor, via a drain socket (not illustrated).

The bowl portion 4 further has a second spout port 14 formed at a position above the pooled-water level W0 to spout flush water supplied from the water conduit (not illustrated) formed inside the rear of the toilet main unit 2. Specifically, the toilet main unit 2 is configured to allow flush water spouted from the second spout port 14 to cause water pooled in the water pooling region 12 to have a flow whirling in an up-down direction.

A flush water tank assembly 16 is provided on an upper surface of the rear of the toilet main unit 2 to store flush water to be supplied to the toilet main unit 2.

Although this embodiment will be described based on an example in which the flush water tank assembly 16 is applied to the above siphon-type flush toilet, a scope of application of the present invention is not limited to the siphon-type flush toilet, but the present invention can also be applied to any other type of flush toilet, such as a so-called wash down-type flush toilet designed to wash away waste by means of a water flow action caused by water head within the bowl portion.

Secondly, based on FIG. 2, an internal structure of the flush water tank assembly 16 will be described below.

Figure 2:
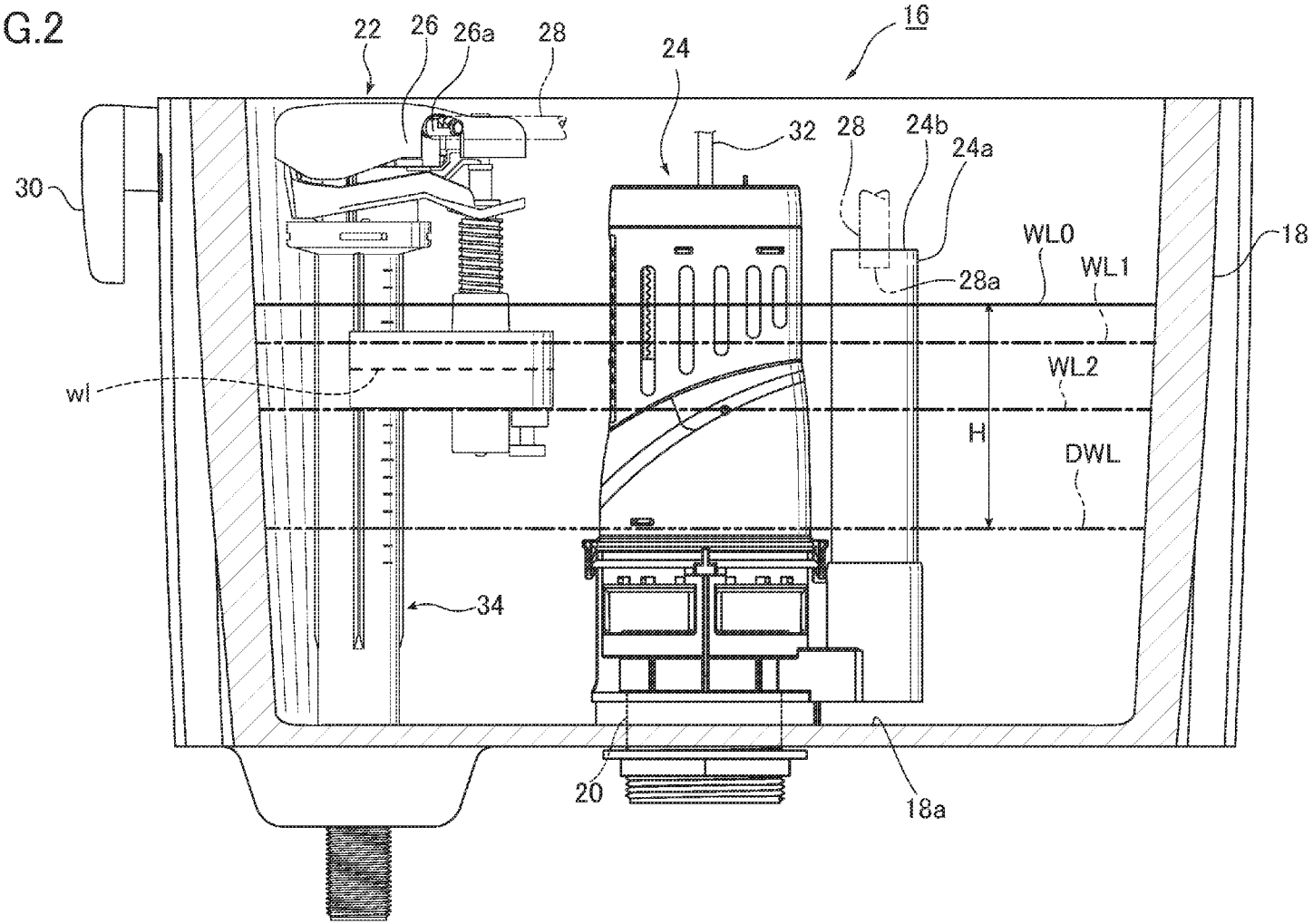
FIG. 2 is a front sectional view illustrating an internal structure of the flush water tank assembly equipped with the flush water supply device according to the embodiment of the present invention.

FIG. 2 is a front sectional view illustrating the internal structure of the flush water tank assembly equipped with the flush water supply device according to this embodiment. In FIG. 2, a maximum water level, a water-stopping water level and a dead water level within an aftermentioned water storage tank are designated by WL0, WL1 and DWL, respectively. Further, a water level within the water storage tank and a water level within an aftermentioned small tank, causing start of water supply through the flush water supply device, are designated by WL2 and w1, respectively.

As illustrated in FIGS. 1 and 2, the flush water tank assembly 16 comprises a water storage tank 18 which as a flush water tank for storing therein flush water for flushing the flush toilet 1. The water storage tank 18 has a bottom formed with a discharge port 20 which is communicated with the water conduit (not illustrated) of the toilet main unit 2 in such a manner as to allow flush water in the water storage tank 18 to be supplied to the water conduit (not illustrated) of the toilet main unit 2. It is to be understood that an amount of flush water to be stored in the water storage tank 18 varies depending types of toilets.

As illustrated in FIG. 2, the flush water tank assembly 16 further comprises a flush water supply device 22 and a water discharge valve device 24 each provided inside the water storage tank 18, wherein the flush water supply device 22 is designed to supply flush water into the water storage tank 18, and the water discharge valve device 24 is designed to open the discharge port 20 so as to cause flush water stored in the water storage tank 18 to flow into the water conduit (not illustrated) of the toilet main unit 2.

Further, an overflow pipe 24*a* is provided on a lateral side of the water discharge valve device 24 to extend in an up-down direction. A lower end of a passage inside the overflow pipe 24*a* is communicated with the discharge port 20. Thus, even in a situation where the water level within the water storage tank 18 is raised beyond the maximum water level WL0 and reaches an upper end opening 24*b* of the overflow pipe 24*a*, flush water flowing from upper end opening 24*b* into the overflow pipe 24*a* can be discharged from the discharge port 20 to the water conduit (not illustrated) of the toilet main unit 2.

Further, an upstream end of a refill water hose 28 is connected to a refill water pipe 26*a* of an aftermentioned refill water system 26 of the flush water supply device 22, and a downstream end 28*a* of the refill water hose 28 is disposed just above or inside the overflow pipe 24*a*. Thus, refill water supplied from the refill water pipe 26*a* of the refill water system 26 of the flush water supply device 22 to the refill water hose 28 flows into the overflow pipe 24*a* so as to be supplied to the toilet main unit 2 as refill water for refilling the toilet main unit 2 therewith.

The water discharge valve device 24 has the same configuration as that of a conventional water discharge valve device. Specifically, although not described in detail, the water discharge valve device 24 is configured such that, when a manual operation lever 30 attached to an outer side of the water storage tank 18 is manually turned in a direction for causing a given flushing mode (a full flushing mode or a partial flushing mode) to be performed, a valve element (not illustrated) thereof is pulled upwardly by a control wire 32 interlockingly coupled to the manual operation lever 30, and thereby the discharge port 20 is opened for a given period of time to allow a certain amount of flush water in the water storage tank 18 to be discharged to the water conduit (not illustrated) of the toilet main unit 2.

Thirdly, with reference to FIGS. 2 to 20, details of the flush water supply device according to this embodiment will be described below.

Figure 3:
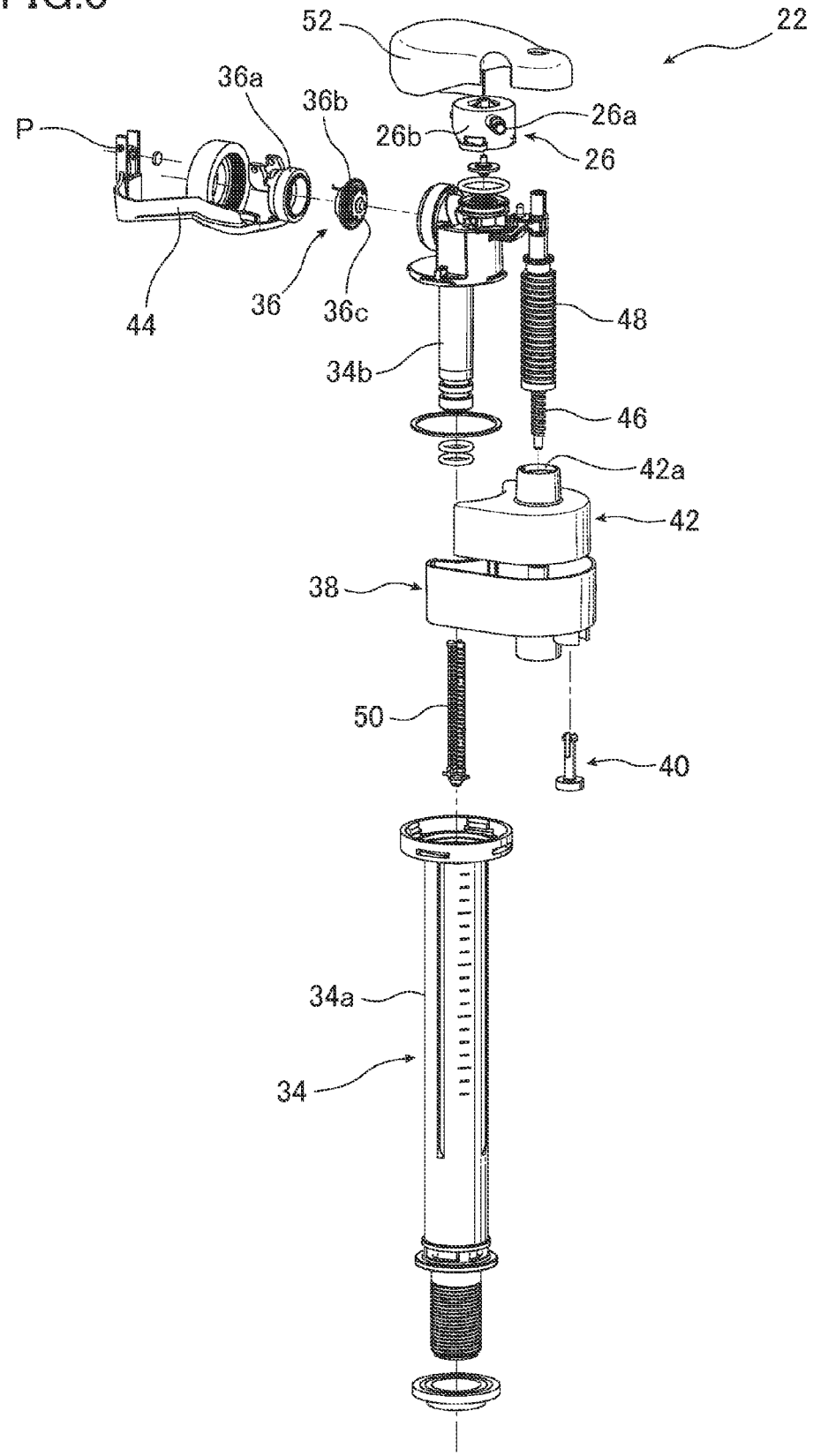
FIG. 3 is an exploded perspective view illustrating the flush water supply device according to the embodiment of the present invention.
Figure 4:
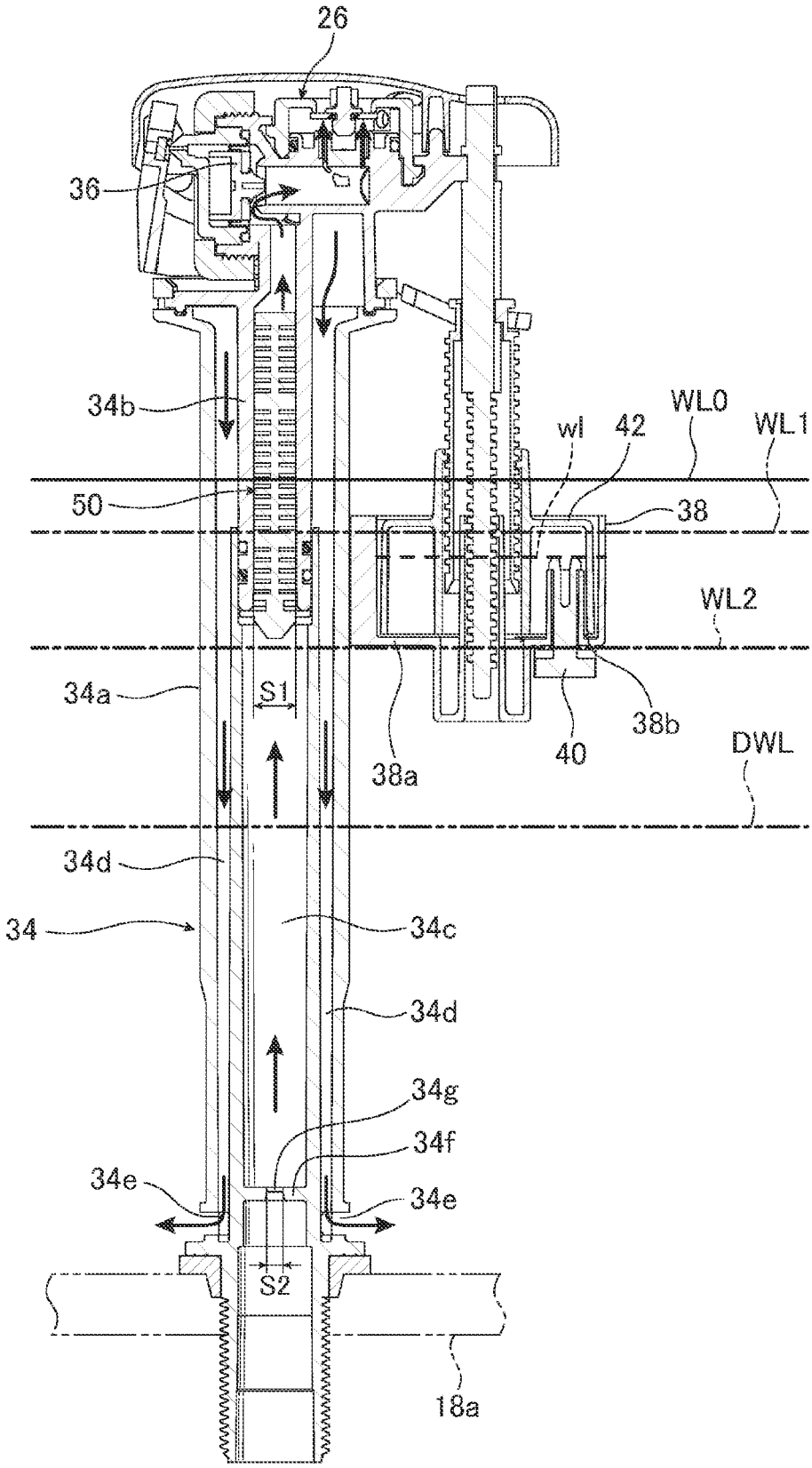
FIG. 4 is a front sectional view illustrating the flush water supply device according to the embodiment of the present invention.

FIG. 3 is an exploded perspective view illustrating the flush water supply device according to this embodiment, and FIG. 4 is a front sectional view illustrating the flush water supply device according to this embodiment. In FIG. 4, the maximum water level, the water-stopping water level and the dead water level within the water storage tank 18 are designated by WL0, WL1 and DWL, respectively. Further, the water level within the water storage tank 18 and the water level within the aftermentioned small tank, causing start of water supply through the flush water supply device 22, are designated by WL2 and w1, respectively.

Figure 5:
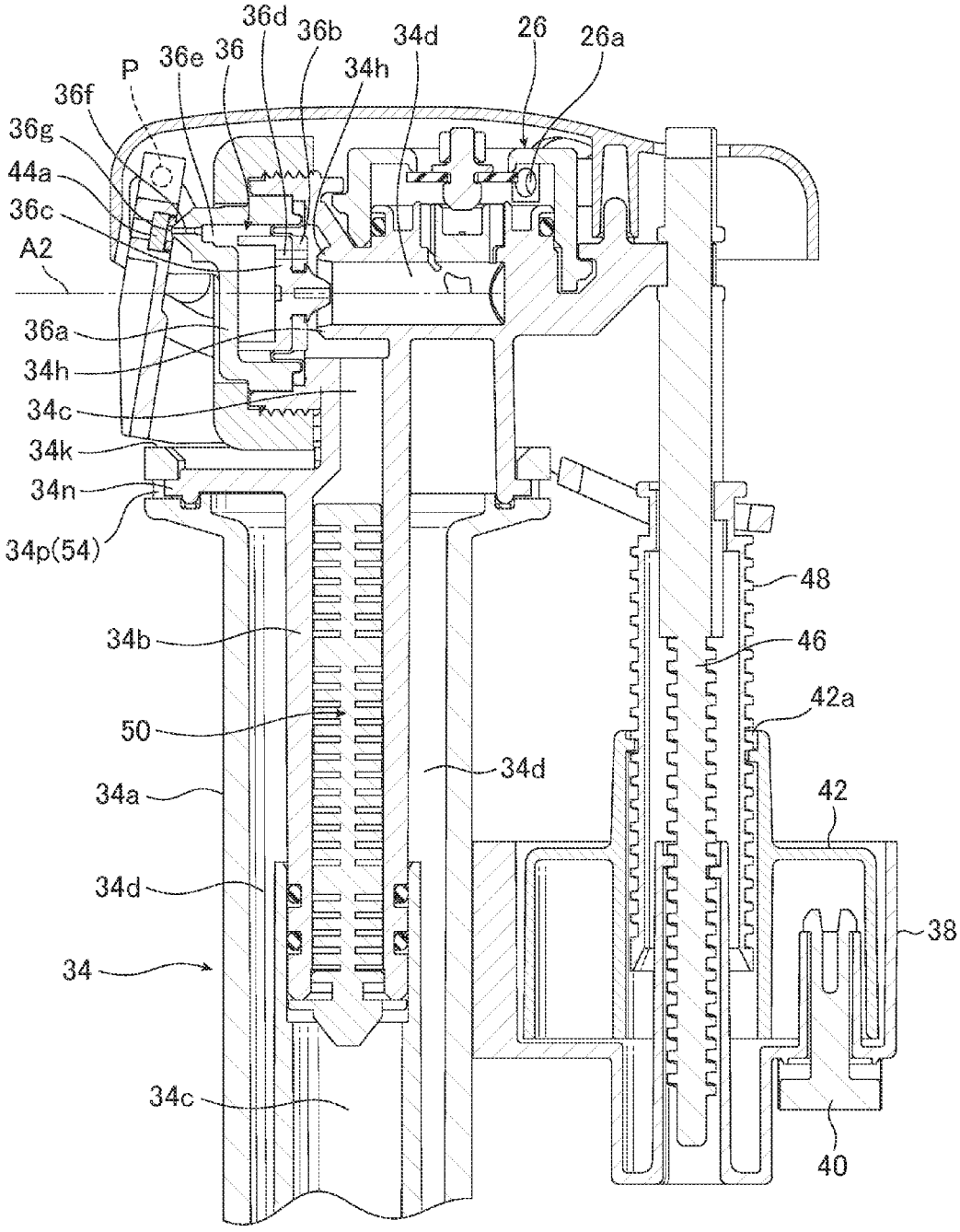
FIG. 5 is a fragmentary enlarged sectional view enlargedly illustrating a part of the flush water supply device according to the embodiment of the present invention, in a water supplying state (in an open state of a water supply valve).
Figure 6:
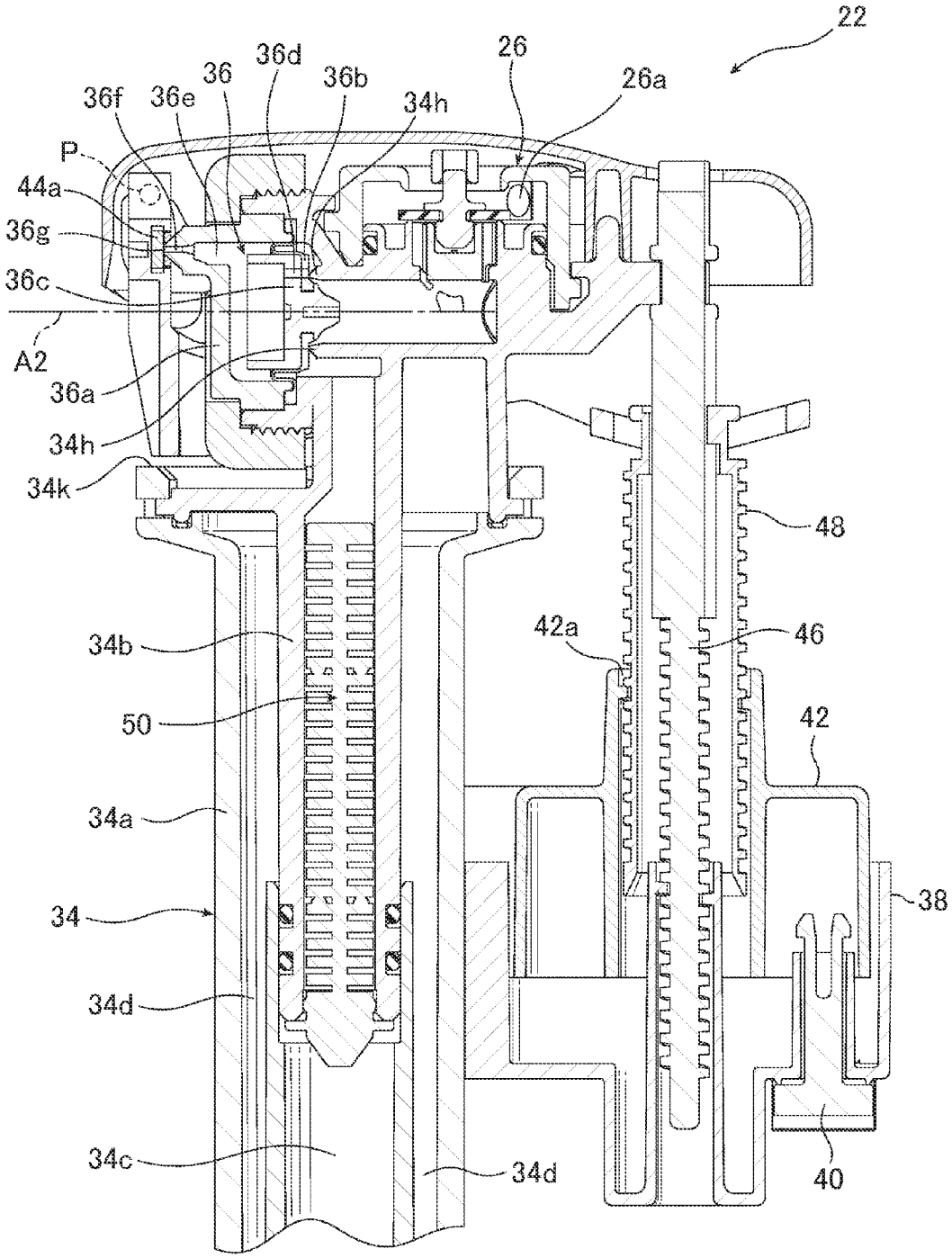
FIG. 6 is a fragmentary enlarged sectional view enlargedly illustrating a part of the flush water supply device according to the embodiment of the present invention, in a water stopping state (in a closed state of a water supply valve).

FIG. 5 is a fragmentary enlarged sectional view enlargedly illustrating a part of the flush water supply device according to this embodiment, in a water supplying state (in an open state of an aftermentioned water supply valve), and FIG. 6 is a fragmentary enlarged sectional view enlargedly illustrating a part of the flush water supply device according to this embodiment, in a water stopping state (in a closed state of the aftermentioned water supply valve).

In FIG. 4 and FIG. 5, water flows in a primary water supply passage and a secondary water supply passage are indicated by the arrowed lines.

As illustrated in FIGS. 2 to 6, the flush water supply device 22 according to this embodiment comprises a water supply pipe 34 connected to an external water supply source (not illustrated) and extending upwardly from a bottom wall 18*a* of the water storage tank 18, and a diaphragm type water supply valve 36 provided above and in laterally offset relation to the water supply pipe 34 and adapted to switch between a water supplying state and a water stopping state with respect to an inside of the water storage tank 18, in terms of flush water supplied from the water supply pipe 34.

The flush water supply device 22 further comprises: a small tank 38 detachably attached to the water supply pipe 34; a check valve 40 adapted to open and close an opening 38*b* formed in a bottom wall 38*a* of the small tank 38; a float 42 provided inside the small tank 38 and adapted to be moved upwardly and downwardly according to a change in water level within the small tank 38; and a swingable member 44 having one end connected to the float 42 and the other end connected to the water supply valve 36. The swingable member 44 is adapted, according to the upward and downward movements of the float 42, to be swingably moved about a fulcrum (support point) P located adjacent to the water supply valve 36, thereby causing opening and closing of the water supply valve 36.

In this embodiment, the opening 38*b* is formed in the bottom wall 38*a* of the small tank 38. Alternatively, it may be formed in a lateral wall of the small tank 38.

Furthermore, the flush water supply device 22 comprises: a small tank position-adjusting fixed shaft member 46 fixed above and in laterally offset relation to the water supply pipe 34 and capable of adjusting a position of the small tank 38 with respect to the water supply pipe 34 in an up-down direction; and an adjustment shaft member 48 attached to a distal end of the swingable member 44 and the float 42 so as to connect them together and screwed into a mounting hole 42*a* formed in an approximately central region of the float 42, in a manner capable of adjusting a vertical relative position between the distal end of the swingable member 44 and the float 42.

As illustrated in FIGS. 2 to 4, the water supply pipe 34 comprises a lower water supply pipe 34*a* attached to the bottom wall 18*a* of the water storage tank 18 and connected to an external water source (not illustrated) such as a city water line, and an upper water supply pipe 34*b* connected to an upper side of the lower water supply pipe 34*a*. The water supply pipe 34 has a primary water supply passage 34*c* formed in a central region of each of the lower water supply pipe 34*a* and the upper water supply pipe 34*b* to extend in an up-down direction, and a secondary water supply passage 34*d* formed thereinside and outside the primary water supply passages 34*c*.

As illustrated in FIG. 4, a lower end of the secondary water supply passage 34*d* of the lower water supply pipe 34*a* is formed as an outlet port 34*e*, so that flush water inside the secondary water supply passage 34*d* is supplied from the outlet port 34*e* into the water storage tank 18.

Further, as illustrated in FIG. 4, an end wall 34*f* of the lower water supply pipe 34*a* on an upstream side of the primary water flow passage 34*c* therein is formed with an orifice hole 34*g* which has a cross-sectional flow area less than that of the primary water flow passage 34*c* of the lower water supply pipe 34*a*, at any position on a downstream side of the end wall 34*f*. An instantaneous flow rate of flush water can be adjusted depending on a size of the orifice hole 34*g* (cross-sectional flow area of the orifice hole 34*g*).

As illustrated in FIGS. 3 and 4, a lower portion of the upper water supply pipe 34*b* is inserted into an upper end of the lower water supply pipe 34*a*, and a filter member 50 is installed inside a region of the primary water supply passage 34*c* in a lower portion of the upper water supply pipe 34*b* to remove foreign particles contained in flush water flowing from the lower water supply pipe 34*a* into the upper water supply pipe 34*b*.

Figure 7:
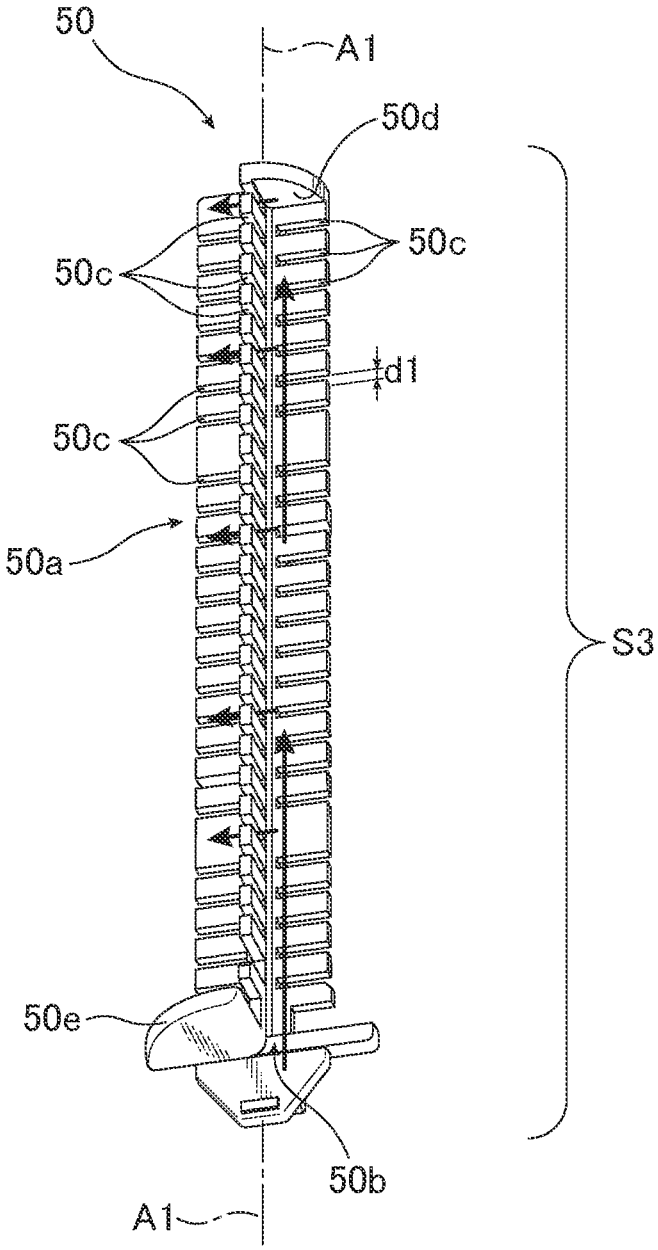
FIG. 7 is a perspective view illustrating a filter member of the flush water supply device according to the embodiment of the present invention, when viewed obliquely rearwardly and upwardly from a front side thereof.
Figure 8:
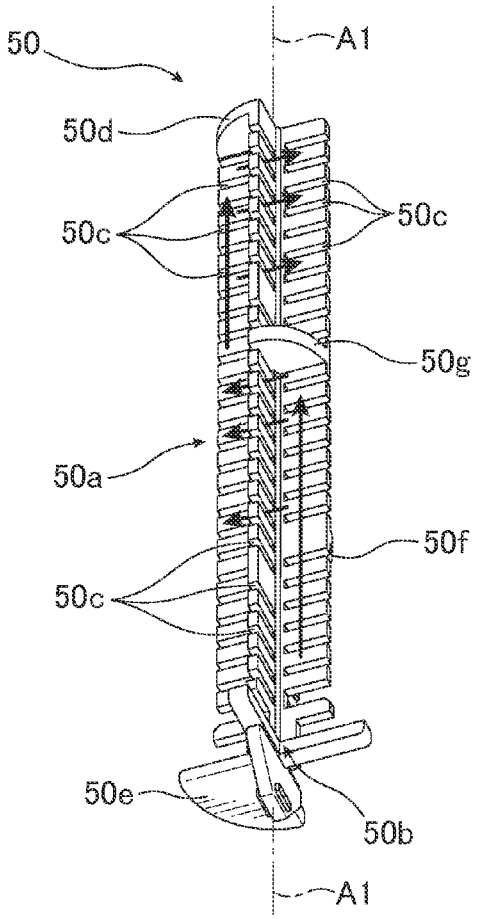
FIG. 8 is a perspective view illustrating the filter member of the flush water supply device according to the embodiment of the present invention, when viewed obliquely frontwardly and upwardly from a rear side thereof.
Figure 9:
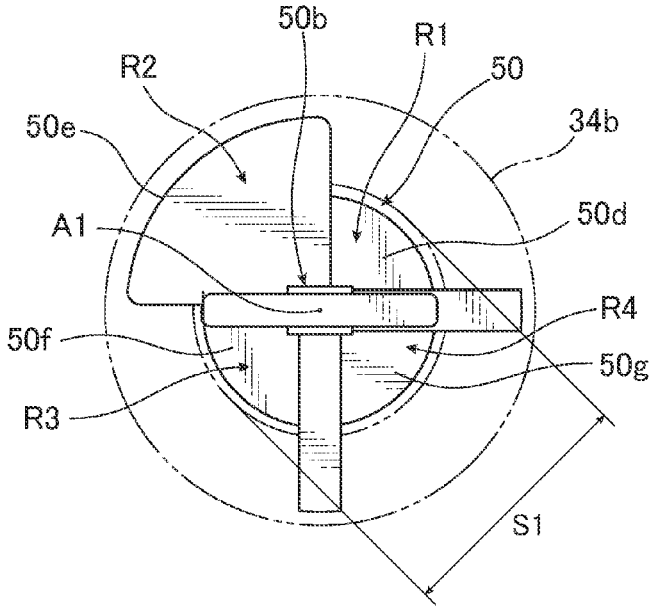
FIG. 9 is a bottom view illustrating the filter member of the flush water supply device according to the embodiment of the present invention.

FIG. 7 and FIG. 8 are perspective views illustrating the filter member of the flush water supply device according to this embodiment, respectively, when viewed obliquely rearwardly and upwardly from a front side thereof and when viewed obliquely frontwardly and upwardly from a rear side thereof, and FIG. 9 is a bottom view illustrating the filter member. In FIGS. 7 and 8, a flow of water passing through the filter member is indicated by the arrowed lines.

As illustrated in FIGS. 3 to 9, the filter member 50 has a water passing portion 50*a* for allowing flush water to pass therethrough, thereby removing foreign particles from the flush water, and an attaching portion 50*b* provided at a lower end of the water passing portion 50*a*. The attaching portion 50*b* is adapted to be press-fitted into the primary water supply passage 34*c* of the upper water supply pipe 34*b* from therebelow to thereby allow the filter member 50 to be fixed inside the primary water supply passage 34*c* of the upper water supply pipe 34*b*.

In a state in which the attaching portion 50*b* of the filter member 50 is press-fitted into and fixed inside the primary water supply passage 34*c* of the upper water supply pipe 34*b*, the filter member 50 is fixed while keeping the water passing portion 50*a* of the filter member 50 from being twisted about a longitudinal axis A1 thereof, which makes it possible to avoid an undesirable situation where, due to twisting of the water passing portion 50*a*, a cross-sectional flow area S1 (see FIGS. 4 and 9) of the filter member 50 becomes less than a cross-sectional flow area S2 (see FIG. 4) of the orifice hole 34*g*.

As illustrated in FIGS. 7 and 8, the water passing portion 50*a* of the filter member 50 has a plurality of slits 50*c* formed to extend laterally and arranged side-by-side in the up-down direction, wherein a distance d1 between adjacent ones of the slits 50*c* is set to approximately the same value. Further, a total cross-sectional flow area S3 of the water passing portion 50*a* defined by the plurality of slits 50*c* is set to be greater than the cross-sectional flow area S2 (see FIG. 4) of the orifice hole 34*g* of the lower water supply pipe 34*a*. This makes it possible to suppress a situation where, when flush water flows from the lower water supply pipe 34*a* into the upper water supply pipe 34*b* and passes through the filter member 50, the filter member 50 is easily clogged due to foreign particles contained in the flush water, and pressure loss occurs during passing through the filter member 50.

As illustrated in FIGS. 7 to 9, four partition members 50*d* to 50*g* are provided to block, in the up-down direction, water being passing through the filter member 50, respectively, in four regions R1 to R4 formed by dividing a horizontal section of the filter member 50 into front, rear, right and left regions. Specifically, in the region R1, the partition member 50*d* is provided at an upper end of the water passing portion 50*a* of the filter member 50. In the region R2, the partition member 50*e* is provided at a lower end of the water passing portion 50*a* of the filter member 50. In the region R3, the partition member 50*f* is provided at an intermediate position of the water passing portion 50*a* of the filter member 50. In the region R4, the partition member 50*g* is provided at an intermediate position of the water passing portion 50*a* of the filter member 50.

Figure 10:
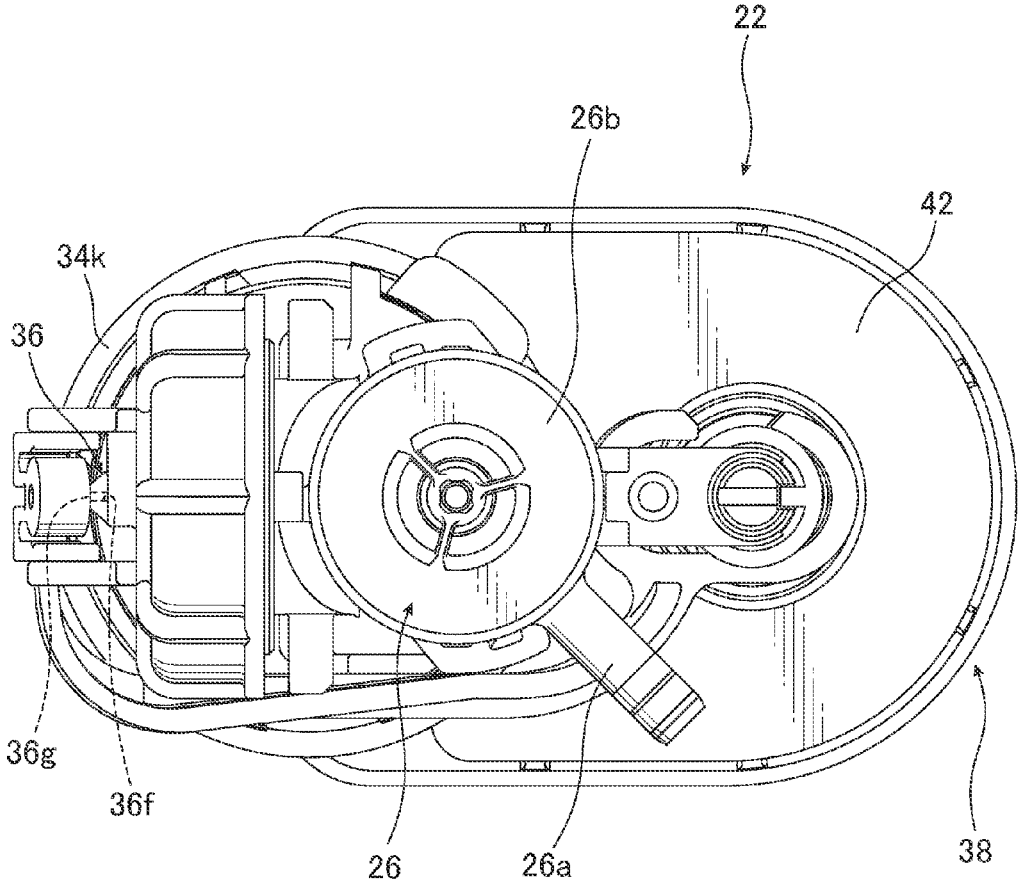
FIG. 10 is a top plan view illustrating the flush water supply device according to the embodiment of the present invention, wherein a cover member is removed therefrom.

FIG. 10 is a top plan view illustrating the flush water supply device according to this embodiment, wherein a cover member is removed therefrom.

As illustrated in FIGS. 3 to 6 and 10, in a state in which a cover member 52 covering an upper side of a housing 26*b* of the aftermentioned refill water system 26 is removed, the diaphragm type water supply valve 36 is provided above and in laterally offset relation to the upper water supply pipe 34*b*.

Further, a refill water pipe 26*a* of a refill water system 26 is provided on an upper side of the upper water supply pipe 34*b* and on a downstream side of the water supply valve 36. The refill water system 26 is adapted to allow flush water supplied from the water supply valve 36 to be supplied to the water storage tank 18, and further supplied to the toilet main body 2 as refill water for refilling the toilet main body 2 therewith.

As illustrated in FIGS. 3, 5 and 6, the water supply valve 36 is a so-called diaphragm type which is provided to be interposed between the primary water supply passage 34*c* of the upper water supply pipe 34*b* extending in the up-down direction, and a secondary water supply passage 34*d* of the upper water supply pipe 34*b* extending in a horizontal direction. The water supply valve 36 comprises: a valve housing 36*a* having a central axis A2 extending in the horizontal direction; a diaphragm 36*b* attached to the valve housing 36*a* concentrically with respect to the central axis A2 and adapted to be displaceable along the central axis A2 in a right-left direction (in FIGS. 5 and 6); and a valve element 36*c* attached to the diaphragm 36*b* and adapted to be displaceable in the right-left direction (in FIGS. 5 and 6) integrally together with the diaphragm 36*b*.

The diaphragm 36*b* is formed with a bleed hole 36*d* extending parallel to the central axis A2. Through the bleed hole 36*d*, the primary water supply passage 34*c* of the upper water supply pipe 34*b* and a back pressure chamber 36*e* located on a lateral side with respect to the diaphragm 36*b* are communicated with each other. A portion of the valve housing 36*a* located laterally beside the back pressure chamber 36*e* is formed with a pilot hole 36*f*.

As illustrated in FIGS. 5 and 6, the swingable member 44 is attached to a lateral side of the valve housing 36*a* of the water supply valve 36, swingably about a fulcrum P located at an end of the valve housing 36*a*. The swingable member 44 comprises a valve member 44*a* for opening and closing the pilot hole 36*f* of the water supply valve 36 according to the swinging movement. Specifically, the valve member 44*a* of the swingable member 44 is adapted to open and close the pilot hole 36*f* of the water supply valve 36, thereby making it possible to switch between the water supplying state and the water stopping state according to the water supply valve 36.

FIG. 5 illustrates a state (water supplying state) in which, when a water level within the small tank 38 becomes approximately zero, the float 42 is moved downwardly to a lowermost position to cause the swingable member 44 to be swingingly moved downwardly about the fulcrum P, so that the valve member 44*a* is moved to open the pilot hole 36*f* of the water supply valve 36, and thereby the valve element 36*c* is displaced leftwardly (in FIG. 5) to open a valve seat 34*h* located at an upstream end of the secondary water supply passage 46*b* of the secondary water supply passage 34*d*.

On the other hand, FIG. 6 illustrates a state (water stopping state) in which the float 42 is moved upwardly to an uppermost position to cause the swingable member 44 to be swingingly moved upwardly about the fulcrum P, so that the valve member 44*a* is moved to close the pilot hole 36*f* of the water supply valve 36, and thereby the valve element 36*c* is displaced rightwardly (in FIG. 5) to close the valve seat 34*h* located at the upstream end of the secondary water supply passage 34*d*.

Figure 11:
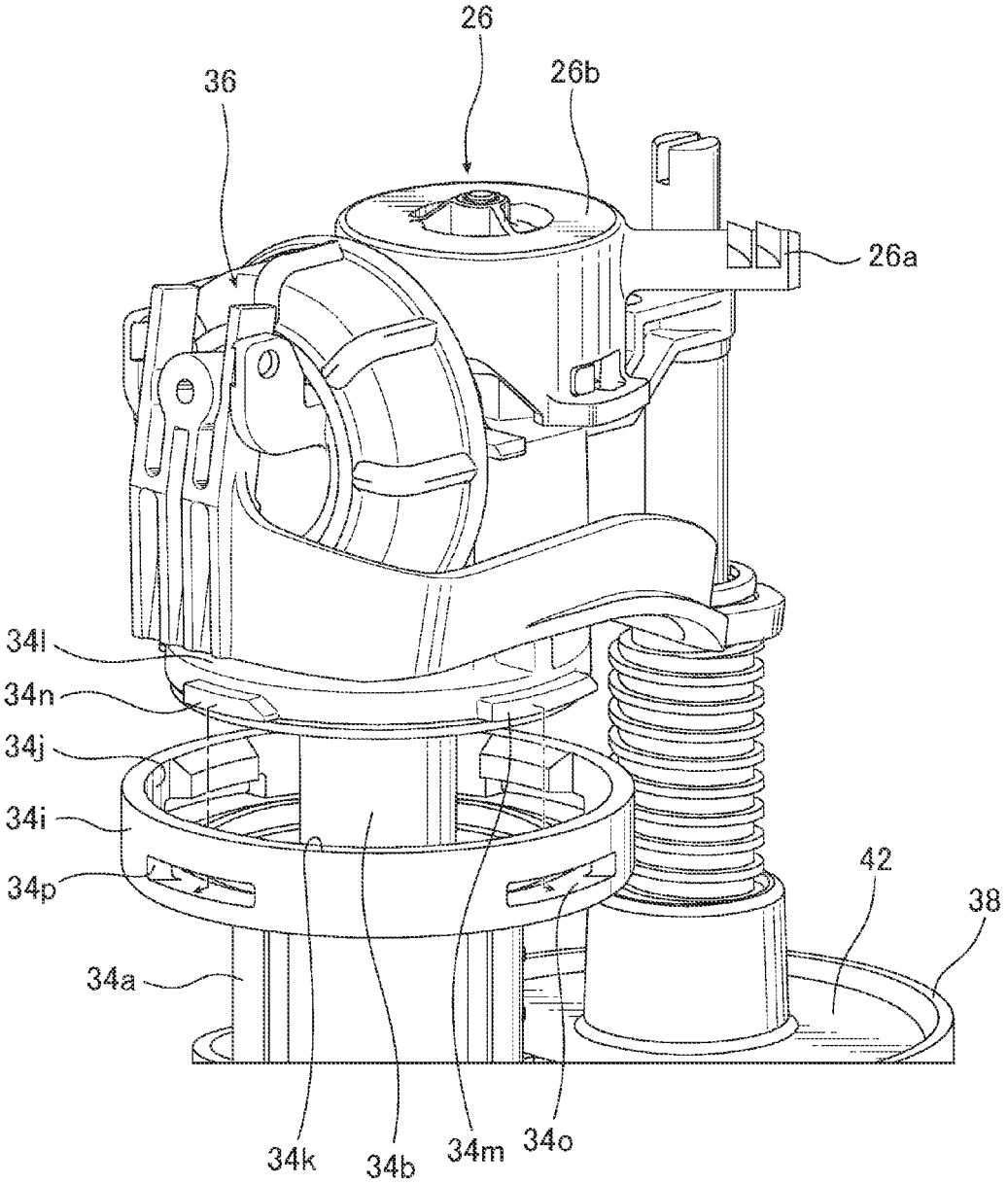
FIG. 11 is a fragmentary exploded perspective view illustrating an upper portion of the flush water supply device according to the embodiment of the present invention, when viewed obliquely frontwardly from a rear side thereof, wherein the cover member is removed therefrom.
Figure 12:
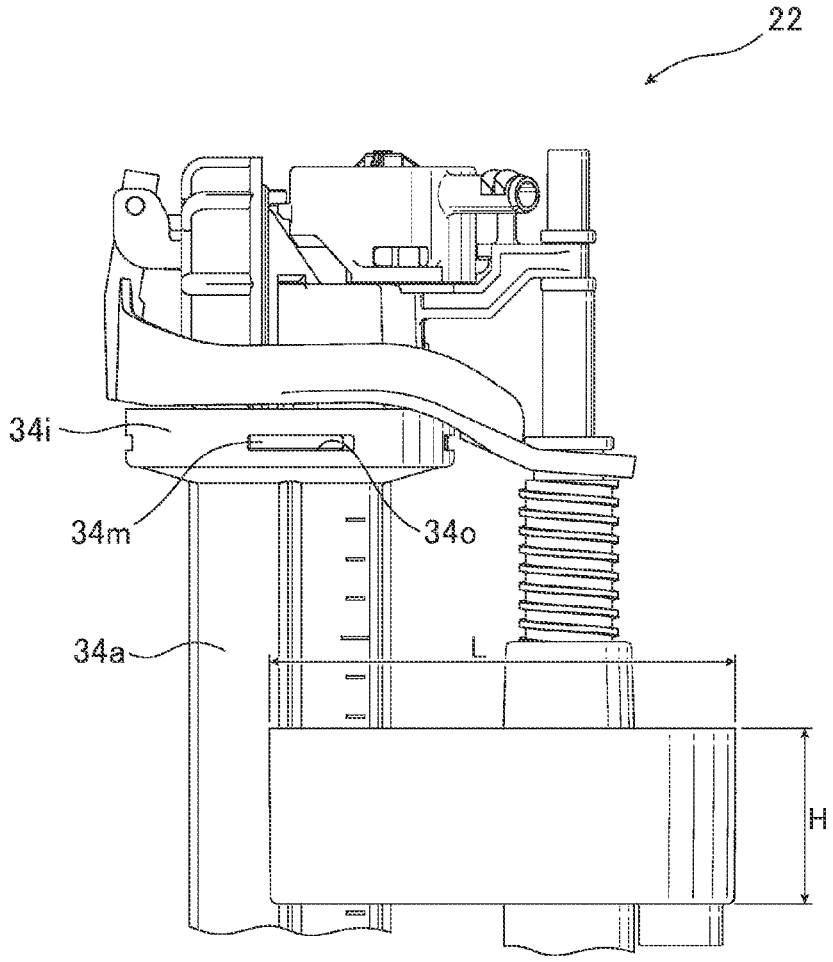
FIG. 12 is a front view illustrating the upper portion of the flush water supply device according to the embodiment of the present invention, wherein the cover member is removed therefrom.
Figure 13:
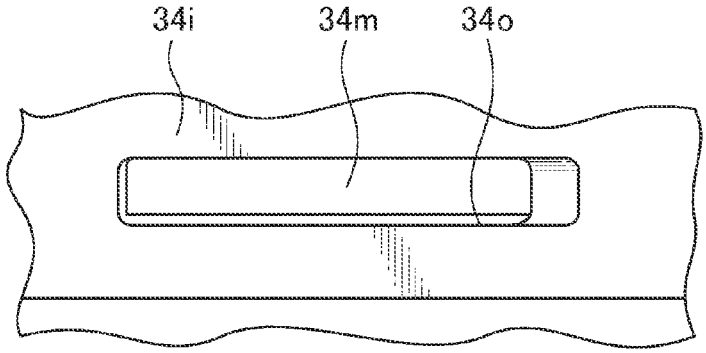
FIG. 13 is a fragmentary enlarged view illustrating a region of the flush water supply device according to the embodiment of the present invention in FIG. 12, where a fitting protrusion formed on a front portion of an upper water supply pipe is fitted in a fitting hole formed in a front portion of a lower water supply pipe.
Figure 14:
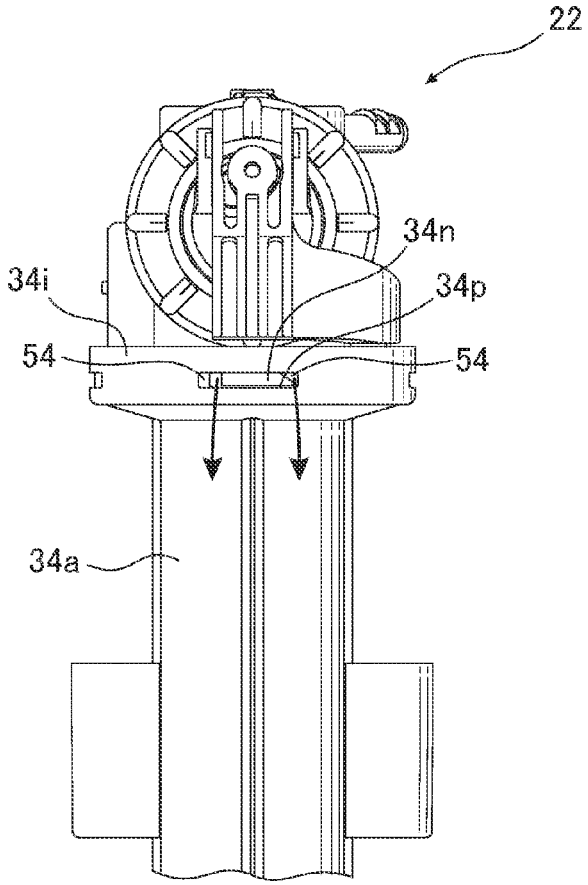
FIG. 14 is a side view illustrating the upper portion of the flush water supply device according to the embodiment of the present invention, wherein the cover member is removed therefrom.

FIG. 11 is a fragmentary exploded perspective view of an upper portion of the flush water supply device according to this embodiment, when viewed obliquely frontwardly from a rear side thereof, wherein the cover member is removed therefrom, and FIG. 12 is a front view illustrating the upper portion of the flush water supply device according to this embodiment, wherein the cover member is removed therefrom. FIG. 13 is a fragmentary enlarged view of an attaching section at an upper end of the flush water supply device according to this embodiment illustrated in FIG. 12, and FIG. 14 is a side view illustrating the upper portion of the flush water supply device according to this embodiment, wherein the cover member is removed therefrom.

As illustrated in FIGS. 3 to 6, 10 and 11, the lower water supply pipe 34*a* has an upper end 34*i* formed as an annular-shaped concave portion 34*j* which protrudes outwardly and then protrudes upwardly from a distal end of the outwardly protruding portion. The concave portion 34*j* is formed to have an upper peripheral edge 34*k* located outward of an exit 36*g* of the pilot hole 36*f* of the water supply valve 36, in top plan view. This makes it possible to reliably receive flush water flowing out of the exit 36*g* of the pilot hole 36*f*, by the concave portion 34*j* at the upper end 34*i* of the lower water supply pipe 34*a*, thereby preventing flush water flowing out of the exit 36*g* of the pilot hole 36*f* from flowing into the small tank 38. Thus, it becomes possible to prevent the occurrence of an undesirable situation where, before a water-stopping water level WL1 within the water storage tank 18 reaches a prescribed water level necessary for toilet flushing, a water level within the small tank 38 is raised, and the float 42 is moved upwardly, so that the water supply valve 36 is prematurely closed, resulting in erroneous stopping of water supply.

Further, as illustrated in FIGS. 3 to 6, 10 and 11, the small tank 38 and the float 42 are arranged on an opposite side of the exit 36*g* of the pilot hole 36*f* of the water supply valve 36 with respect to the lower water supply pipe 34*a*. Thus, even if flush water flows out of the exit 36*g* of the pilot hole 36*f* when the float 42 is moved downwardly and the water supply valve 36 operates to open the pilot hole 36*f*, it becomes possible to allow the flush water flowing out of the exit 36*g* of the pilot hole 36*f* to flow out on the opposite side of the small tank 38 and the float 42, thereby preventing the flush water flowing out of the exit 36*g* of the pilot hole 36*f* from flowing into the small tank 38.

As illustrated in FIGS. 3 to 6, 10 and 11, the upper water supply pipe 34*b* has an annular-shaped concave portion 34*l* which is provided at a height position approximately equal to an upper end of the filter member 50 installed inside the primary water supply passage 34*c* of the upper water supply pipe 34*b*, and formed to protrude outwardly and then protrude upwardly from an distal end of the outwardly protruding portion. The annular-shaped concave portion 34*l* of the upper water supply pipe 34*b* has total four fitting protrusions: two front and rear fitting protrusions 34*m* and two right and left fitting protrusions 34*n*, which are formed to protrude outwardly from an outer peripheral surface of the concave portion 34*l* and arranged at even intervals along a circumferential direction of the concave portion 34*l*.

Correspondingly, the concave portion 34*j* at the upper end 34*i* of the lower water supply pipe 34*a* has total four fitting holes: two front and rear fitting holes 34*o* and two right and left fitting holes 34*p*, which are formed in an outer peripheral surface of the concave portion 34*j* and arranged at even intervals along a circumferential direction of concave portion 34*j*. When the upper water supply pipe 34*b* is insertingly attached to the lower water supply pipe 34*a* from thereabove, each of the fitting protrusions 34*m*, 34*n* of the upper water supply pipe 34*b* is fitted into a corresponding one of the fitting holes 34*o*, 34*p* of the lower water supply pipe 34*a*.

FIG. 12 is a front view illustrating the upper portion of the flush water supply device according to this embodiment, wherein the cover member is removed therefrom. FIG. 13 is a fragmentary enlarged view illustrating a region of the flush water supply device according to this embodiment in FIG. 12, where the fitting protrusion formed on a front portion of the upper water supply pipe is fitted in the fitting hole formed in a front portion of the lower water supply pipe.

Figure 15:
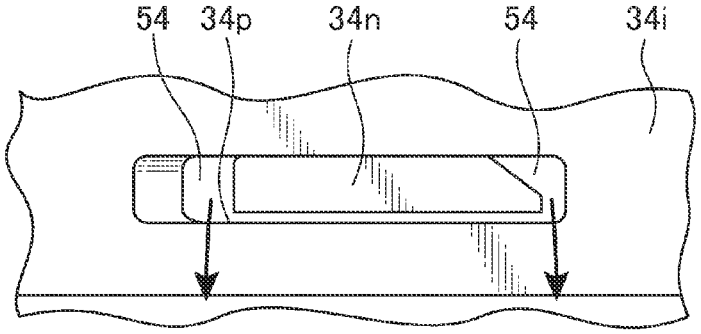
FIG. 15 is a fragmentary enlarged view illustrating a region of the flush water supply device according to the embodiment of the present invention in FIG. 14, in which a fitting protrusion formed on a left lateral portion of the upper water supply pipe is fitted in a fitting hole formed in a left lateral portion of the lower water supply pipe.

FIG. 14 is a left side view illustrating the upper portion of the flush water supply device according to this embodiment, wherein the cover member is removed therefrom. FIG. 15 is a fragmentary enlarged view illustrating a region of the flush water supply device according to this embodiment in FIG. 14, in which the fitting protrusion formed on a left lateral portion of the upper water supply pipe is fitted in the fitting hole formed in a left lateral portion of the lower water supply pipe.

As illustrated in FIGS. 12 and 13, each of the fitting protrusions 34*m* of the upper water supply pipe 34*b* is fitted in a corresponding one of the fitting holes 34*o* of the lower water supply pipe 34*a* without a gap therebetween.

On the other hand, as illustrated in FIGS. 5, 14 and 15, each of the fitting protrusions 34*n* of the upper water supply pipe 34*b* is fitted in a corresponding one of the fitting holes 34*p* of the lower water supply pipe 34*a*, to define therebetween a drain port 54 for allowing water to pass therethrough in a direction from an inside of the concave portion 34*j* at the upper end 34*a* of the lower water supply pipe 34*a* to the outside. In FIGS. 5, 14 and 15, a flow of water flowing out of the drain port 54 on a left lateral side of the upper end 34*i* of the lower water supply pipe 34*a* is indicated by the arrowed lines.

Any fitting protrusion other than the fitting protrusions 34*n* of the upper water supply pipe 34*b* and any corresponding fitting hole other than the fitting holes 34*p* of the lower water supply pipe 34*a* are fitted together without a gap therebetween, i.e., the drain port 54 for allowing water to pass therethrough in the direction from the inside of the concave portion 34*j* at the upper end 34*a* of the lower water supply pipe 34*a* to the outside is not defined therebetween.

That is, the drain port 54 for allowing water to pass therethrough in the direction from the inside of the concave portion 34*j* at the upper end 34*a* of the lower water supply pipe 34*a* to the outside is arranged on the opposite side of the small tank 38 and the float 42 with respect to the lower water supply pipe 34*a*. Therefore, as illustrated in FIG. 5, flush water received by the concave portion 34*j* at the upper end 34*i* of the lower water supply pipe 34*a* after flowing out of the exit 36*g* of the pilot hole 36*f* is drained from the drain ports 54 to the opposite side of the small tank 38 and the float 42 with respect to the lower water supply pipe 34*a*, so that it becomes possible to prevent flush water flowing out of the exit 36*g* of the pilot hole 36*f* from flowing into the small tank 38. Thus, it becomes possible to prevent the occurrence of the undesirable situation where, before the water-stopping water level WL1 within the water storage tank 18 reaches a prescribed water level necessary for toilet flushing, the water level within the small tank 38 is raised, and the float 42 is moved upwardly, so that the water supply valve 36 is prematurely closed, resulting in erroneous stopping of water supply.

As illustrated in FIGS. 10 and 12, the small tank 38 is formed in a generally horizontally-long flattened shape in which a maximum vertical length H becomes less than a maximum horizontal (longitudinal) length L by a given value.

A ratio of the maximum vertical length H to the maximum horizontal (longitudinal) length L of the small tank 38 (hereinafter referred to as "vertical to horizontal ratio H/L") is set, preferably, in the range of 1/2.25 to 1/2.28.

In this case, based on the small tank having a flattened shape in which a maximum vertical length becomes less than a maximum horizontal length by a given value, it becomes possible to shorten a time period required for fully storing flush water therein after the water level within the water storage tank 18 is raised to cause the check valve 40 to close the opening 38*b* formed in the bottom wall 38*a* of the small tank 38. Therefore, supposing that flush water flowing out of the pilot hole 36*f* of the water supply valve flows into the small tank 638, an amount of the flush water to be received by and stored in the small tank 38 can be reduced. Thus, it becomes possible to prevent the occurrence of the undesirable situation where, before the water-stopping water level within the water storage tank 18 reaches a prescribed water level necessary for toilet flushing, the water level within the small tank 38 is raised, and the float 42 is moved upwardly, so that the water supply valve 36 is prematurely closed, resulting in erroneous stopping of water supply.

Further, a height dimension of the small tank 38 effective in capacity can be set to a relatively small value. Thus, when the water level within the water storage tank 18 is raised, and flush water flows into the small tank 38, it becomes possible to rapidly store water, as compared to a small tank having a non-flattened shape, so as to quickly move the float 42 upwardly and promptly stop the water supply valve 36 to establish a water stopping state.

Further, supposing that flush water flowing out of the exit 36*g* of the pilot hole 36*f* of the water supply valve 36 flows into the small tank 38, the flush water will flow into the small tank 38 after the water-stopping water level WL1 within the water storage tank 18 reaches the prescribed water level necessary for toilet flushing, and the water level within the small tank 38 is raised to establish the water stopping state. This makes it possible to prevent the occurrence of the undesirable situation where, before the water-stopping water level WL1 within the water storage tank 18 reaches the prescribed water level necessary for toilet flushing, the water level within the small tank 38 is raised, and the float 42 is moved upwardly, so that the water supply valve 36 is prematurely closed, resulting in erroneous stopping of water supply.

Figure 16:
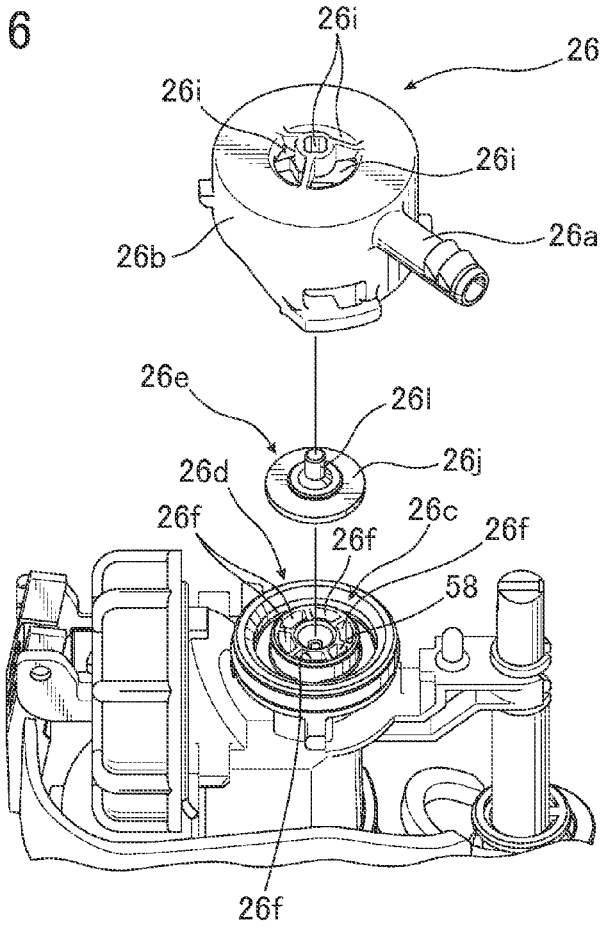
FIG. 16 is an exploded perspective view illustrating a refill water system of the flush water supply device according to the embodiment of the present invention.
Figure 17:
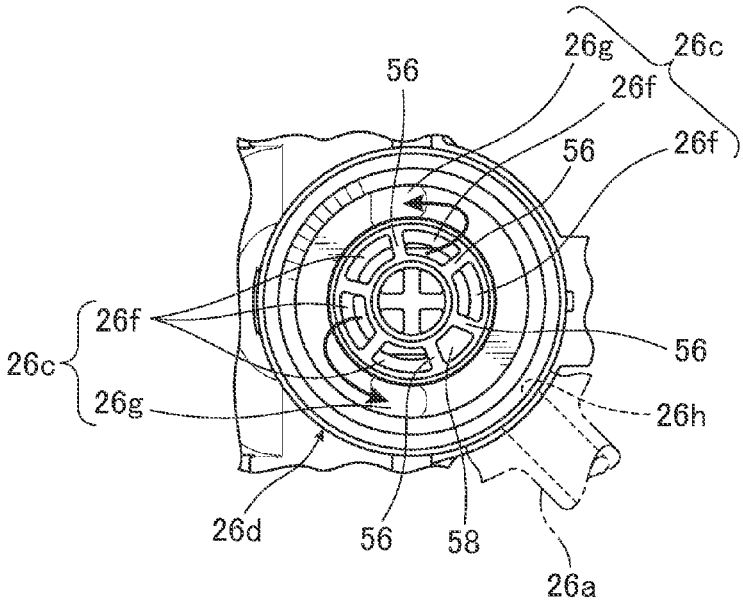
FIG. 17 is a top plan view illustrating a common passage-forming portion provided inside the refill water system of the flush water supply device according to the embodiment of the present invention.

FIG. 16 is an exploded perspective view illustrating the refill water system of the flush water supply device according to this embodiment, and FIG. 17 is a top plan view illustrating a common passage-forming portion provided inside the refill water system of the flush water supply device according to this embodiment.

As illustrated in FIGS. 3 to 6, 10 and 16, the refill water pipe 26*a* is formed to extend obliquely frontwardly from a lateral wall of the housing 26*b* of the refill water system 26 provided just above the horizontally-extending secondary water supply passage 34*d* of the upper water supply pipe 34*b*, and adapted to branch a part of water flow from the secondary water supply passage 34*d* of the upper water supply pipe 34*b* into an inside of the housing, and spout the branched water into the water storage tank 18 as refill water.

As illustrated in FIGS. 16 and 17, the refill water system 26 is designed to allow flush water flowing in the secondary water supply passage 34*d* of the upper water supply pipe 34*b* after passing through the water supply valve 36 to supplied from the refill water pipe 26*a* to the toilet main unit 2 via the refill water hose 28 and the overflow pipe 24*a*, as refill water for refilling the toilet main unit 2 therewith, and further supplied to the water storage tank 18 via the secondary water supply passage 34*d* of the lower water supply pipe 34*a* and through the outlet port 34*e* of the secondary water supply passage 34*d* of the lower water supply pipe 34*a*. The refill water system 26 comprises a common passage-forming portion 26*d* forming a common passage 26*c* in which flush water to be supplied to the toilet main unit 2 as refill water for refilling the toilet main unit 2 therewith, and flush water to be supplied to the water storage tank 18 through the outlet port 34*e* of the secondary water supply passage 34*d* of the lower water supply pipe 34*a*, flow integrally before being branched into them.

The common passage-forming portion 26*d* is provided just above the upper water supply pipe 34*b*, to allow flush water in the secondary water supply passage 34*d* of the upper water supply pipe 34*b* after passing through the water supply valve 36 when the water supply valve 36 is in the open state, to pass through the common passage 26*c* thereof.

Further, a vacuum break valve 26*e* is provided between the common passage-forming portion 26*d* and the housing 26*b*, and adapted to open and close the common passage 26*c* of the common passage-forming portion 26*d*. The vacuum break valve 26*e* functions as a vacuum breaker for, when the inside of the common passage 26*c* as a water supply side (primary side) becomes a negative pressure or vacuum, breaking the vacuum.

Figure 18:
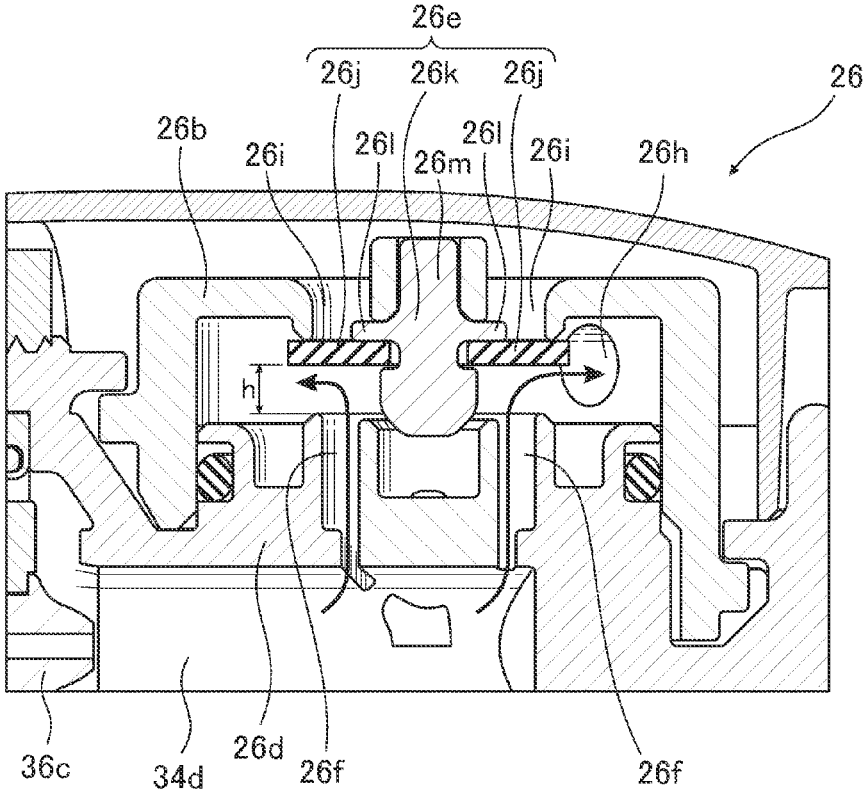
FIG. 18 is a fragmentary enlarged front sectional view enlargedly illustrating a part of the refill water system of the flush water supply device according to the embodiment of the present invention, in the water supplying state (in the open state of the water supply valve).
Figure 19:
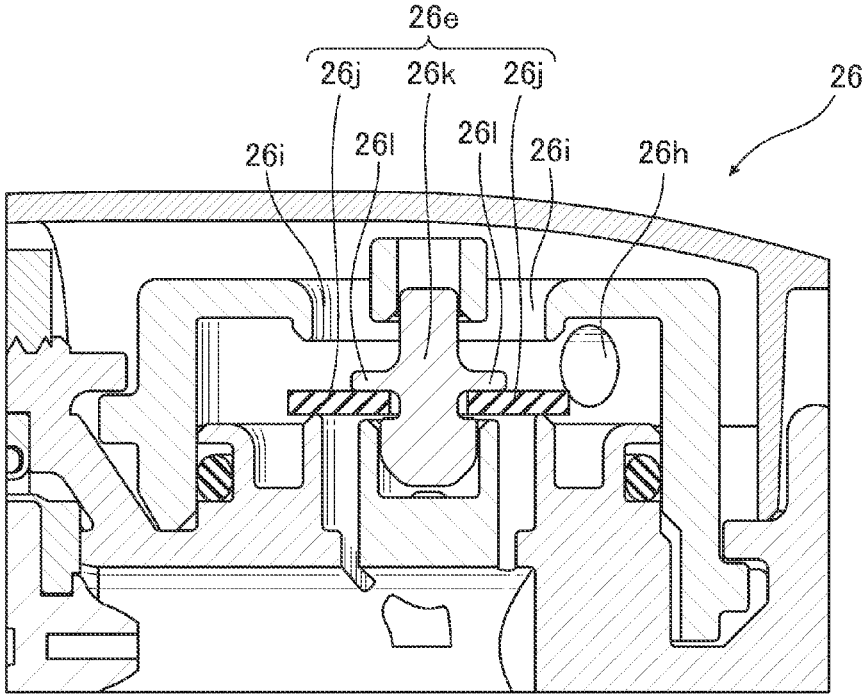
FIG. 19 is a fragmentary enlarged front sectional view enlargedly illustrating a part of the refill water system of the flush water supply device according to the embodiment of the present invention, in the water stopping state (in the closed state of the water supply valve).
Figure 20:
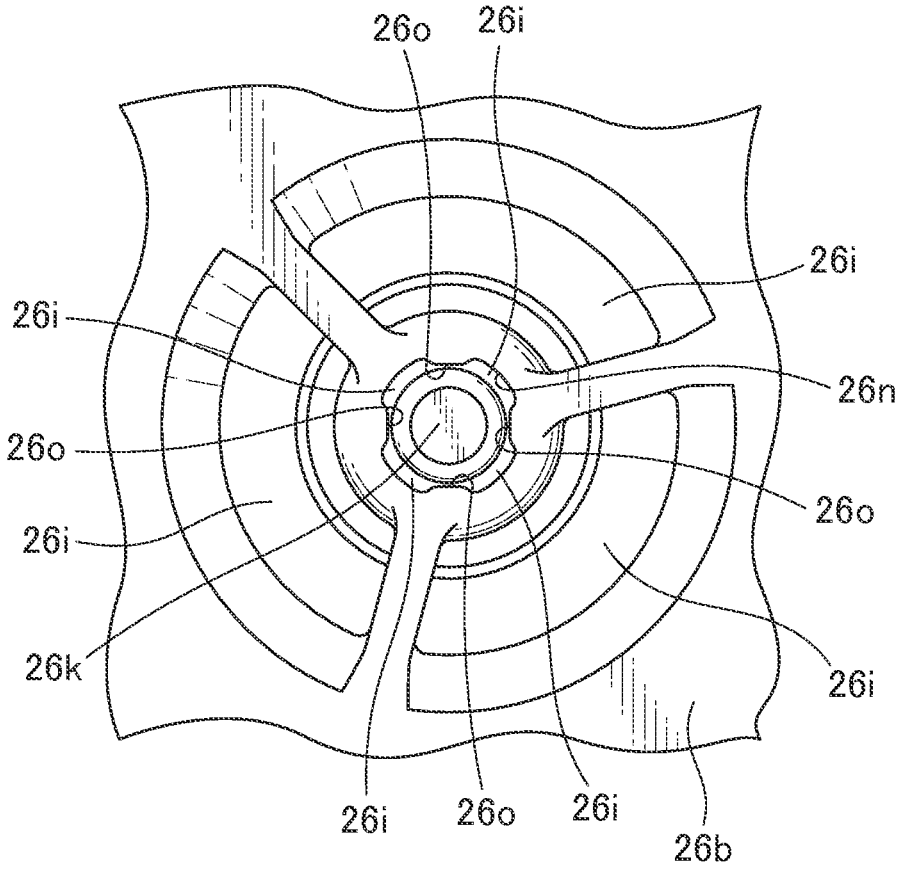
FIG. 20 is a fragmentary enlarged front sectional view enlargedly illustrating an inward wall partially defining the common passage-forming portion, a valve element holding member and a vent port, in the refill water system of the flush water supply device according to the embodiment of the present invention.

FIG. 18 and FIG. 19 are fragmentary enlarged front sectional views enlargedly illustrating a part of the refill water system of the flush water supply device according to this embodiment, respectively, in the water supplying state (in the open state of the water supply valve) and in the water stopping state (in the closed state of the water supply valve), and FIG. 20 is a fragmentary enlarged front sectional view enlargedly illustrating an inward wall partially defining the common passage-forming portion, a valve element holding member and a vent port, in the refill water system of the flush water supply device according to this embodiment. In FIG. 18, a flow of flush water is indicated by the arrowed lines.

As illustrated in FIGS. 16 to 20, the common passage 26*c* of the common passage-forming portion 26*d* comprises: an inlet port 26*f* for allowing therethrough inflow of flush water passing through the water supply valve 36; a tank-side outlet port 26*g* for allowing flush water inflowing through the inlet port 26*f* to flow out toward the water storage tank 18 therethrough; a main unit-side outlet port 26*h* for allowing flush water inflowing through the inlet port 26*f* to flow out into the refill water pipe 26*a* therethrough, so as to be supplied to the toilet main body 2 via the refill water hose 28 and the overflow pipe 24*a* as refill water for refilling the toilet main body 2 therewith; and a vent port 26*i* formed in an upper wall of the housing 26*b* at a position just above the inlet port 26*f* and communicated with outside air.

As illustrated in FIGS. 16 to 20, the vacuum break valve 26*e* comprises a valve element 26*j* for opening and closing the common passage 26*c*, and a valve element holding member 26*k* holding the valve element 26*j* in an up-down direction. The valve element holding member 26*k* has an upper portion 26*m* located above an upper holding portion 26*l* thereof and adapted to be guided in the up-down direction by an inward wall 26*n* which defines the vent hole 26*i* of the common passage 26*c* in an approximately central region of the housing 26*b*. The valve element 26*j* of the vacuum break valve 26*e* is adapted to be movable between the inlet port 26*f* and the vent port 26*i* of the common passage 26*c* in the up-down direction by a given distance h (see FIG. 18).

For example, the above given distance h is set preferably in the range of 1 to 4 mm, most preferably in the range of 2 to 3 mm.

As illustrated in FIG. 20, the inward wall 26*n* partially defining the common passage 26*c* has an inner peripheral surface along which the upper portion 26*m* of the valve element holding member 26*k* is guided. The inner peripheral surface of the inward wall 26*n* has four point-contact protrusions 26*o* formed to protrude inwardly and arranged along a circumferential direction of inward wall 26*n* at even intervals, so as to allow the upper portion 26*m* of the valve element holding member 26*k* of the vacuum break valve 26*e*, and the inner wall 26*n* partially defining the common passage 26*c*, to be maintained in point-contact relation with each other. This allows the valve element holding member 26*k* of the vacuum break valve 26*e* to be moved in the up-down direction while being in point-contact relation with the inward wall 26*n* partially defining the common passage 26*c*, which makes it possible to normally move the valve element 26*j* of the vacuum break valve 26*e*. In a state in which the valve element 26*j* of the vacuum break valve 26*e* is normally moved upwardly to open the inlet port 26*f* and close the vent port 26*i* of the common passage 26*c*, a flush water passing area in the common passage 26*c* of the common passage-forming portion 26*d* and the housing 26*b* of the refill water system 26 can be set to a relatively large value.

This embodiment has been described based on one example where the point-contact protrusion 26*o* is provided on the inner peripheral surface of the inward wall 26*n* partially defining the common passage 26*c*. However, instead of providing the point-contact protrusion 26*o* on the inner peripheral surface of the inward wall 26*n* partially defining the common passage 26*c*, the point-contact protrusion may be provided on an outer peripheral surface of the upper portion 26*m* of the valve element holding member 26*k*.

Further, as illustrated in FIGS. 16 to 19, the inlet port 26*f* of the common passage 26*c* is circumferentially divided into a plurality of (in this embodiment, six) inlet sub-ports by a partition wall 56, and one 58 of the inlet sub-ports most adjacent to the main unit-side outlet port 26*h* is permanently closed. Thus, flush water flowing into the common passage

26*c* through the inlet port 26*f* can be smoothly guided to the tank-side outlet port 26*g* and the main unit-side outlet port 26*h*.

Next, with reference to FIGS. 1 to 20, operations (functions) of the flush water supply device according to this embodiment, the flush water tank assembly equipped with the flush water supply device, and the flush toilet equipped with the flush water tank assembly, will be described.

In two types of flushing modes: a full flushing mode and a partial flushing mode, to be performed by the flush water tank assembly equipped with the water supply valve device in this embodiment, fundamental operations during the full flushing mode and during the partial flushing mode are the same, except that: a time period of an open state of the discharge port 20 of the water storage tank 18 during the full flushing mode is greater than that during the partial flushing mode, because a pull-up amount of the valve element (not illustrated) of the water discharge valve device 24 by the control wire 32 during the full flushing mode is greater than that during the partial flushing mode; and the dead water level DWL during the full flushing mode is lower than that during the partial flushing mode. Thus, the following description will be made about only operations during the full flushing mode.

As illustrated in FIGS. 2, 4 and 6, in a state just before start of water discharge by the water discharge valve device 24, the valve element (not illustrated) of the water discharge valve device 24 closes up the discharge port 20, so that an initial water level within the water storage tank 18 becomes equal to the maximum water level WL0 (see FIGS. 2 and 4), and the float 42 is located under flush water.

Then, as illustrated in FIGS. 2, 4 and 6, when a user manually moves the manual operation lever 30, the water discharge valve device 24 operates to open the discharge port 20 of the water storage tank 18 to start water discharge from the flush water tank assembly 16 to the toilet main unit 2 of the flush toilet 1, in the full flushing mode, so that the water level within the water storage tank 18 starts being lowered. In this process, the float 42 is moved upwardly by means of buoyancy based on flush water in the small tank 38, and then maintained in a stationary state at its uppermost position.

Then, as illustrated in FIGS. 2, 4 and 6, when the water level within the water storage tank 18 is lowered with respect to the maximum water level WL0, but the water level within the water storage tank 18 and the water level within the small tank 38 are higher than respective ones of the water level WL2 and the water level w1 causing start of water supply through the flush water supply device 22, the float 42 is still maintained in a stationary state at the uppermost position, so that water supply through the flush water supply device 22 is not performed even when the water level within the water storage tank 18 is lowered to the water-stopping water level WL1.

Then, as illustrated in FIGS. 2 and 4 to 6, when the water level within the water storage tank 18 becomes lower than the water level WL2 which is approximately equal to a height position of the bottom wall 38*a* of the small tank 38, the check valve 40 is moved downwardly to open the opening 38*b* formed in the bottom wall 38*a* of the small tank 38.

Thus, flush water in the small tank 38 is drained from gaps with respect to the opening 38*b* of the bottom wall 38*a* of the small tank 38, and the water level within the small tank 38 starts being lowered from its maximum water level equal to a height position of an upper edge of the small tank 38. In this process, before the water level within the small tank 38 is lowered to the water supply starting water level w1, buoyancy acting on the float 42 by flush water in the small tank 38 is greater than a self-weight of the float 42, so that the float 42 is still maintained in a stationary state at the uppermost position. In this embodiment, the water supply starting water level w1 within the small tank 38 is set to be higher than the water supply starting water level WL2 within the water storage tank 18.

On the other hand, when the water level within the small tank 34 is lowered beyond the water supply starting water level w1, the buoyancy acting on the float 42 becomes less than the self-weight of the float 42, so that the float 42 is moved downwardly. Then, as illustrated in FIGS. 4 and 5, according to the downward movement of the float 42, the swingable member 44 is swingingly moved about the fulcrum P, and the valve member 44*a* of the swingable member 44 is moved to open the pilot hole 36*f* of the water supply valve 36, so that the valve element 36*c* is moved leftwardly (in FIG. 5) to establish a state in which the valve seat 34*h* located at the upstream end of the secondary water supply passage 34*d* of the upper water supply pipe 34*b* is opened (water supplying state). Thus, flush water flowing from the secondary water supply passage 34*d* of the upper water supply pipe 34*b* into the inlet port 26*f* of the common passage 26*c* is divided into flush water to be supplied from the tank-side outlet port 26*g* of the common passage 26*c* to the inside of the water storage tank 18 through the outlet port 34*e* of the secondary water supply passage 34*d* of the lower water supply pipe 34*a*, and flush water to be supplied from the main unit-side outlet port 26*h* and the refill water pipe 26*a* of the common passage 26*c* to the toilet main unit 2 via the refill water hose 28 and the overflow pipe 24*a*, as refill water for refilling the toilet main unit 2 therewith.

In this process, as illustrated in FIG. 18, the valve element 26*j* of the vacuum break valve 26*e* in the refill water system 26 is moved upwardly to its highest position by receiving a pressure of flush water inflowing through the inlet port 26*f* of the common passage 26*c*, to close the vent port 26*i* of the refill water system 26. In this state, when a vacuum occurs in the common passage 26*c* as the water supply side (primary side), the valve element 26*j* is moved to close the vent hole 26*i* to break the vacuum.

Then, as illustrated in FIGS. 2, 4 and 5, when the water level within the water storage tank 18 is lowered to the dead water level DWL, the water discharge valve device 24 operates to close the discharge port 20 of the water storage tank 18. During the above process, the water level within the small tank 38 becomes zero, so that the water supply valve 36 is kept opened to allow the water supply to the water storage tank 18 to be continuously performed through the flush water supply device 22. Thus, the water level within the water storage tank 18 is gradually raised from the dead water level DWL.

Then, when the water level within the water storage tank 18 is raised to the water level WL2, the check valve 40 is moved upwardly to close the opening 38*b* of the bottom wall 38*a* of the small tank 38.

At this timing, the water level within the small tank 38 is still kept zero. However, when the water level within the water storage tank 18 is further raised to cause flush water to flow into the small tank 38 beyond the upper edge of the small tank 38, the water level within the small tank 38 is rapidly raised, so that the float 42 is quickly moved upwardly to promptly close the water supply valve 36 to establish the water stopping state.

In this state, as illustrating in FIG. 19, the valve element 26*j* of the vacuum break valve 26*e* in the refill water system 26 is moved downwardly to its lowest position because it does not receives any pressure of flush water flowing through the inlet port 26*f* of the common passage 26*c*. Thus, the vent port 26*i* of the refill water system 26 is opened to a position equal to that to be moved when a vacuum occurs in the common passage 26*c* as the water supply side (primary side). When the vent port 26*i* of the refill water system 26 is opened, the vent port 26*i* is kept in fluid communication with the refill water pipe 26*a* and the refill water hose 28. This prevents the occurrence of a situation where water flows back from the refill water pipe 26*a* and the refill water hose 28 to the common passage 26*c*.

As mentioned above, in the flush water supply device 22 according to the above embodiment, as compared, for example, to a different type from the above embodiment where a water supply valve 36 and a vacuum break valve 26*e* are integrated together so that a moving distance of the vacuum break valve 26*e* during opening/closing thereof is relatively small, the valve element 26*j* of the vacuum break valve 26*e* can be moved between the inlet port 26*f* and the vent port 26*i* of the common passage 26*c* in the up-down direction by a relatively large given distance h. Thus, in the state in which the valve element 26*j* of the vacuum break valve 26*e* is moved upwardly to open the inlet port 26*f* and close the vent port 26*i* of the common passage 26*c*, a flush water passing area in the common passage 26*c* of the common passage-forming portion 26*d* of the refill water system 26 can be set to a relatively large value. Therefore, an instantaneous flow rate of flush water to be supplied from the refill water system 26 to the inside of the water storage tank 18, and an instantaneous flow rate of flush water to be supplied from the refill water system 26 to the toilet main unit 2 as refill water for refilling the toilet main unit 2 therewith, can be stabilized. This makes it possible to stabilize a refill amount of refill water for refilling the toilet main unit 2 therewith, and a water accumulation time required for fully storing flush water in the water storage tank 18.

In the flush water supply device 22 according to the above embodiment, the point-contact protrusions 26*o* formed on the inward wall 26*n* partially defining the common passage 26*c* allow the valve element holding member 26*k* of the vacuum break valve 26*e* to be moved in the up-down direction while being maintained in point-contact relation with the inward wall 26*n* partially defining the common passage 26*c*, so that it becomes possible to normally move the valve element 26*j* of the vacuum break valve 26*e* in the up-down direction. Therefore, in the state in which the valve element 26*j* of the vacuum break valve 26*e* is normally moved upwardly to open the inlet port 26*f* and close the vent port 26*i* of the common passage 26*c*, a flush water passing area in the common passage 26*c* of the common passage-forming portion 26*d* of the refill water system 26 can be set to a relatively large value. This makes it possible to stabilize the instantaneous flow rate of flush water to be supplied from the refill water system 26 to the inside of the water storage tank 18, and the instantaneous flow rate of flush water to be supplied from the refill water system 26 to the toilet main unit 2 as refill water for refilling the toilet main unit 2 therewith. In addition, it becomes possible to stabilize the refill amount of refill water for refilling the toilet main unit 2 therewith, and the water accumulation time required for fully storing flush water in the water storage tank 18.

In the case where the inlet port 26*f* of the common passage 26*c* is circumferentially divided into a plurality of inlet sub-ports by the partition wall 56, and all of the plurality of inlet sub-ports are opened without permanently closing the inlet sub-port 58 adjacent to the main unit-side outlet port 26*h*, it is possible to reliably maintain a vacuum breaking capability when the valve element 26*j* of the vacuum break valve 26*e* is moved upwardly to open the plurality of inlet sub-ports 26*f* of the common passage 26*c*. However, flush water flowing into the common passage 26*c* through the inlet sub-ports 26*f* hinders flush water just before flowing out of the tank-side outlet port 26*g* of the common passage 26*c* to generate turbulences in the common passage 26*c*, causing fluctuation in instantaneous flow rate of flush water flowing out of the main unit-side outlet port 26*h* of the common passage 26*c*. In contrast, in the flush water supply device 22 according to the above embodiment, the inlet sub-port 58 most adjacent to the main unit-side outlet port 26*h* of the common passage 26*c* is permanently closed, so that it becomes possible to smoothly guide flush water flowing into the common passage 26*c* through the inlet sub-ports 26*f*, to the tank-side outlet port 26*g* and the main unit-side outlet port 26*h*. Thus, the instantaneous flow rate of flush water to be supplied from the refill water system 26 to the inside of the water storage tank 18, and the instantaneous flow rate of flush water to be supplied from the refill water system 26 to the toilet main unit 2 as refill water for refilling the toilet main unit 2 therewith, can be stabilized. This makes it possible to stabilize the refill amount of refill water for refilling the toilet main unit 2 therewith, and the water accumulation time required for fully storing flush water in the water storage tank 18.

In the flush water supply device 22 according to the above embodiment, the orifice hole 34*g* is formed to have a cross-sectional flow area which is less than that of the primary water flow passage 34*c* of the lower water supply pipe 34*a* at any position on a downstream side of the orifice hole 34*g*, so that it becomes possible to adjust an instantaneous flow rate of flush water depending on the cross-sectional flow area of the orifice hole 34*g*. Thus, the instantaneous flow rate of flush water to be supplied from the refill water system 26 to the inside of the water storage tank 18, and the instantaneous flow rate of flush water to be supplied from the refill water system 26 to the toilet main unit 2 as refill water for refilling the toilet main unit 2 therewith, can be stabilized. This makes it possible to stabilize the refill amount of refill water for refilling the toilet main unit 2 therewith, and the water accumulation time required for fully storing flush water in the water storage tank 18.

In the flush water supply device 22 according to the above embodiment, the upper water supply pipe 34*b* located on a downstream side of the orifice hole 34*g* of the lower water supply pipe 34*a* is internally provided with the filter member 50, wherein the cross-sectional flow area at any position of the passage passing through the filter member 50 is set to be greater than the cross-sectional flow area of the orifice hole 34*g*, so that it becomes possible to suppress a situation where, when flush water flows from the lower water supply pipe 34*a* to the upper water supply pipe 34*b* and passes through the filter member 50, the filter member 50 is easily clogged due to foreign particles contained in the flush water, and pressure loss occurs during passing through the filter member 50. Thus, an instantaneous flow rate of flush water can be adjusted depending on the cross-sectional flow area of the orifice hole 34*g*, so as to stabilize the instantaneous flow rate of flush water to be supplied from the refill water system 26 to the inside of the water storage tank 18, and the instantaneous flow rate of flush water to be supplied from the refill water system 26 to the toilet main unit 2 as refill water for refilling the toilet main unit 2 therewith. This makes it possible to stabilize the refill amount of refill water for refilling the toilet main unit 2 therewith, and the water accumulation time required for fully storing flush water in the water storage tank 18.

In the flush water supply device 22 according to the above embodiment, the attaching portion 50*b* of the filter member 50 is press-fitted into and fixed to the upper water supply pipe 34*a*, so that it becomes possible to fix the filter member 50 while keeping the water passing portion 50*a* of the filter member 50 from being twisted about a longitudinal axis A1 thereof, and to avoid an undesirable situation where, due to the twisting of the water passing portion 50*a*, the cross-sectional flow area S1 (see FIGS. 4 and 9) of the filter member 50 becomes less than the cross-sectional flow area S2 (see FIG. 4) of the orifice hole 34*g* of the lower water supply pipe 34*a*. Thus, an instantaneous flow rate of flush water can be adjusted depending on the cross-sectional flow area of the orifice hole 34*g*, so as to stabilize the instantaneous flow rate of flush water to be supplied from the refill water system 26 to the inside of the water storage tank 18, and the instantaneous flow rate of flush water to be supplied from the refill water system 26 to the toilet main unit 2 as refill water for refilling the toilet main unit 2 therewith. This makes it possible to stabilize the refill amount of refill water for refilling the toilet main unit 2 therewith, and the water accumulation time required for fully storing flush water in the water storage tank 18.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush water supply device for supplying flush water to a flush water tank of a flush toilet, comprising:

a water supply pipe having an upstream end connected to an external water supply source and extending upwardly from a bottom wall of the flush water tank;

a water supply valve for switching between a water supplying state and a water stopping state with respect of an inside of the flush water tank, in terms of flush water supplied from the water supply pipe;

a refill water section provided on a downstream side of the water supply valve and adapted to allow flush water supplied from the water supply valve to be supplied to the flush water tank, and further supplied to a toilet main body of the flush toilet as refill water, the refill water section including a common passage-forming portion which forms a common passage having: an inlet port for allowing therethrough inflow of flush water passing through the water supply valve; a tank-side outlet port for allowing flush water inflowing through the inlet port to flow out toward the inside of the flush water tank therethrough; a main unit-side outlet port for allowing flush water inflowing through the inlet port to flow out toward the toilet main body therethrough; and a vent port formed just above the inlet port and communicated with outside air; and a vacuum break valve provided in the common passage-forming portion, the vacuum break valve having a valve element for opening and closing the common passage, and a valve element holding member adapted to be guided in an up-down direction by an inward wall partially defining the common passage, while clamping the valve element, wherein the valve element of the vacuum break valve is adapted to be movable between the inlet port and the vent port of the common passage in the up-down direction by a given distance.

2. The flush water supply device as defined in claim 1, wherein the valve element holding member of the vacuum break valve is adapted to be guided in the up-down direction by the inward wall partially defining the common passage, and wherein the inward wall partially defining the common passage or the valve element holding member is formed with a point-contact protrusion for allowing the inward wall partially defining the common passage and the valve element holding member to be maintained in point-contact relation with each other.

3. The flush water supply device as defined in claim 1, wherein the inlet port of the common passage is circumferentially divided into a plurality of inlet sub-ports by a wall member, and wherein at least one of the plurality of inlet sub-ports adjacent to the main unit-side outlet port of the common passage is permanently closed.

4. The flush water supply device as defined in claim 1, wherein the water supply pipe has an orifice which is formed in a vicinity of an upstream end of a water flow passage provided thereinside, in such a manner that a cross-sectional flow area of the orifice is less than a cross-sectional flow area of the water flow passage at any position on a downstream side of the orifice.

5. The flush water supply device as defined in claim 4, wherein the water supply pipe comprises: a lower water supply pipe extending upwardly from the bottom wall of the flush water tank and having the orifice in a water flow passage provided thereinside; and an upper water supply pipe connected to an upper side of the lower water supply pipe, the upper water supply pipe being internally provided with a filter member for removing foreign particles contained in flush water flowing from the lower water supply pipe into the upper water supply pipe, and wherein a cross-sectional flow area at any position of a passage passing through the filter member is set to be greater than the cross-sectional flow area of the orifice.

6. The flush water supply device as defined in claim 5, wherein the filter member has a water passing portion for allowing flush water to pass therethrough, thereby removing foreign particles from the flush water, and an attaching portion provided at a lower end of the water passing portion, the attaching portion being press-fitted into the upper water supply pipe, whereby the filter member is fixed to the upper water supply pipe.

7. A flush water tank assembly comprising the flush water supply device as defined in claim 1.

8. A flush toilet comprising the flush water tank assembly as defined in claim 7.

* * * * *